US010336479B2

(12) United States Patent
Deutschle et al.

(10) Patent No.: US 10,336,479 B2
(45) Date of Patent: Jul. 2, 2019

(54) METHOD FOR PACKAGING A PLURALITY OF CONTAINERS FOR SUBSTANCES FOR MEDICAL, PHARMACEUTICAL OR COSMETIC APPLICATIONS, AND PACKAGING STRUCTURE

(71) Applicant: SCHOTT AG, Mainz (DE)

(72) Inventors: Gregor Fritz Deutschle, Idstein (DE); Edgar Pawlowski, Stadecken-Elsheim (DE); Jörn Wassenberg, Mainz (DE); Isabell Dubrau, Basel (CH); Judith Auerbach, Niederteufen (CH)

(73) Assignee: SCHOTT AG, Mainz (DE)

( * ) Notice: Subject to any disclaimer, the term of this patent is extended or adjusted under 35 U.S.C. 154(b) by 0 days.

(21) Appl. No.: 15/343,796

(22) Filed: Nov. 4, 2016

(65) Prior Publication Data

US 2017/0073091 A1 Mar. 16, 2017

Related U.S. Application Data

(63) Continuation of application No. PCT/EP2015/059832, filed on May 5, 2015.

(30) Foreign Application Priority Data

May 5, 2014 (DE) ..... 10 2014 106 197

(51) Int. Cl.
*B65B 5/06* (2006.01)
*B65B 7/02* (2006.01)
(Continued)

(52) U.S. Cl.
CPC ..... *B65B 5/06* (2013.01); *B65B 3/00* (2013.01); *B65B 7/02* (2013.01); *B65D 5/321* (2013.01);
(Continued)

(58) Field of Classification Search
CPC . B65D 5/321; B65D 5/38; B65D 5/68; B65D 11/10; B65D 45/20; B65D 77/003;
(Continued)

(56) References Cited

U.S. PATENT DOCUMENTS 832,086 A 10/1906 Schweitzer
3,104,759 A * 9/1963 Hansen ..... B65D 75/366 206/464
(Continued)

FOREIGN PATENT DOCUMENTS

CN 103068693 4/2013
DE 9112325 11/1991
(Continued)

OTHER PUBLICATIONS

English translation of the Written Opinion dated Sep. 14, 2015 for corresponding PCT/EP2015/059832, 9 pages.
(Continued)

*Primary Examiner* — Chun Hoi Cheung
(74) *Attorney, Agent, or Firm* — Ohlandt, Greeley, Ruggiero & Perle, L.L.P.

(57) ABSTRACT

Disclosed is a method for packaging a plurality of containers for substances for medical, pharmaceutical or cosmetic applications in a packaging structure. The structure has a box-shaped upper part and a box-shaped lower part, forming a box-shaped receptacle in which the containers are accommodated. The plurality of containers are disposed directly on the bottom of the lower part that the containers are supported vertically on the bottom of the lower part, and the upper part is put onto the upper ends of the containers. The positions of the containers on the lower part are secured using side walls that project vertically from the bottom of the lower part and/or of the upper part, and the upper part and/or the lower part is configured and provided in a way that the containers
(Continued)

Figure 1A:
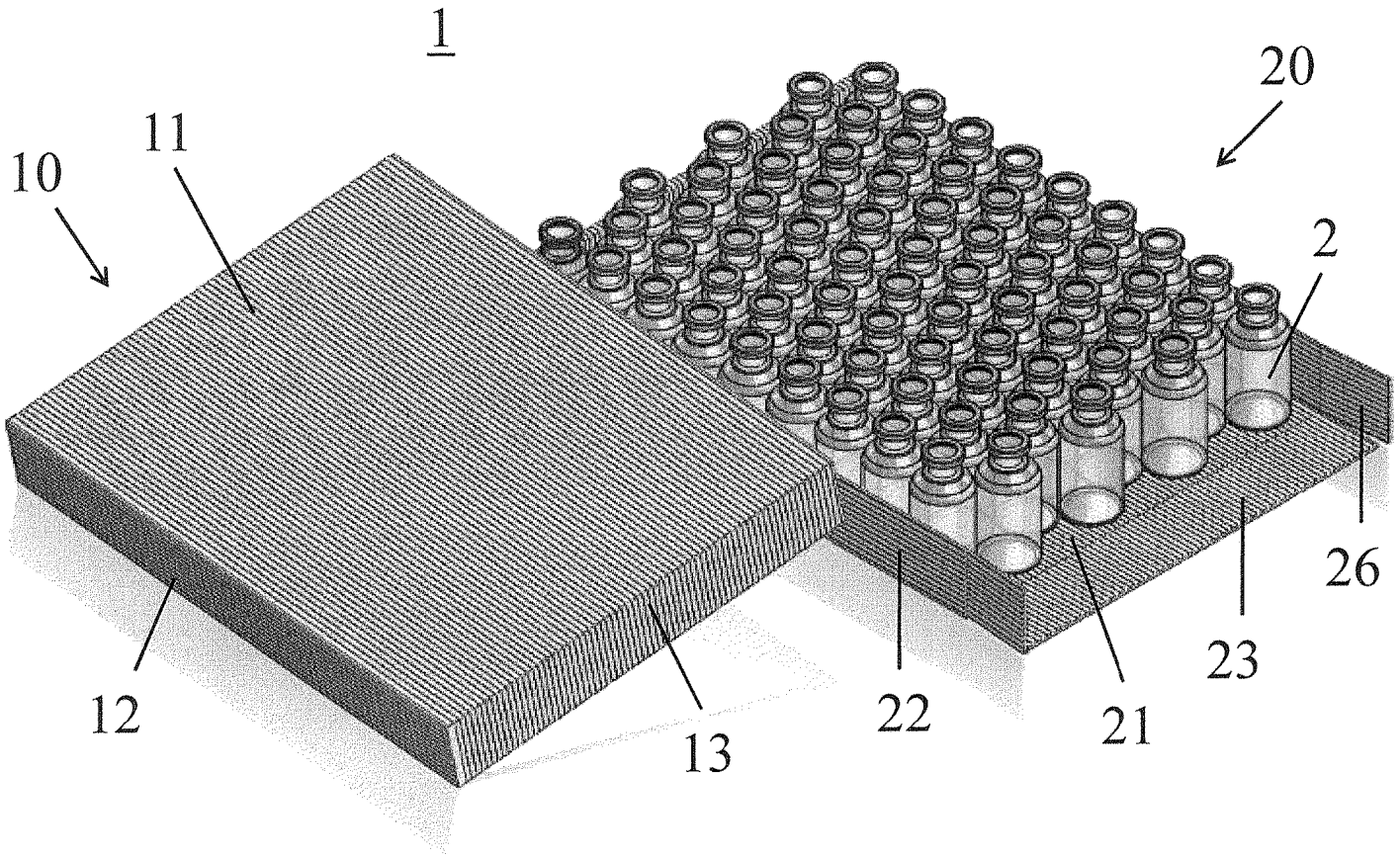

are in direct contact with each other in the box-shaped receptacle and cannot be displaced relative to each other.

11 Claims, 45 Drawing Sheets

(51) Int. Cl.

| | |
|---|---|
| ***B65D 6/00*** | (2006.01) |
| ***B65D 77/00*** | (2006.01) |
| ***B65B 3/00*** | (2006.01) |
| ***B65D 5/68*** | (2006.01) |
| ***B65D 5/32*** | (2006.01) |
| ***B65D 5/38*** | (2006.01) |
| ***B65D 45/20*** | (2006.01) |
| *B65D 5/22* | (2006.01) |
| *B65D 5/24* | (2006.01) |
| *B65D 5/42* | (2006.01) |

(52) U.S. Cl.
CPC ..... *B65D 5/38* (2013.01); *B65D 5/68* (2013.01); *B65D 11/10* (2013.01); *B65D 45/20* (2013.01); *B65D 77/003* (2013.01); *B65D 5/22* (2013.01); *B65D 5/241* (2013.01); *B65D 5/4204* (2013.01); *B65D 2231/005* (2013.01); *B65D 2543/00296* (2013.01); *B65D 2543/00361* (2013.01); *B65D 2543/00574* (2013.01)

(58) Field of Classification Search
CPC ..... B65D 5/22; B65D 5/241; B65D 5/4204; B65D 2231/005; B65B 5/06; B65B 3/00; B65B 7/02
USPC ..... 206/438, 557–567, 167, 432, 461–468; 220/666
See application file for complete search history.

(56) References Cited

U.S. PATENT DOCUMENTS

| | | | | |
|---|---|---|---|---|
| 3,243,049 | A | 3/1966 | Seligmann, Jr. et al. | |
| 3,467,248 | A * | 9/1969 | Makowicki | B65D 73/0092 206/462 |
| 3,537,189 | A | 11/1970 | Bender et al. | |
| 3,815,315 | A | 6/1974 | Glick | |
| 3,815,808 | A | 6/1974 | Bunnell | |
| 3,937,326 | A * | 2/1976 | Schick | B65D 85/36 206/465 |
| 4,101,052 | A | 7/1978 | Dove | |
| 4,119,202 | A * | 10/1978 | Roth | B65D 71/0014 206/432 |
| 4,636,477 | A * | 1/1987 | Ronka | B01L 9/523 436/48 |
| 4,684,024 | A * | 8/1987 | Ebrahim | B65D 45/18 206/464 |
| 4,730,730 | A | 3/1988 | Clarkson | |
| 4,754,595 | A | 7/1988 | Sanderson | |
| 5,469,962 | A | 11/1995 | Kitagawa | |
| 7,766,164 | B2 | 8/2010 | Hurst | |
| 8,100,263 | B2 | 1/2012 | Vanderbush et al. | |
| 8,118,167 | B2 | 2/2012 | Togashi et al. | |
| 2002/0074346 | A1 | 6/2002 | Duquet | |
| 2003/0010665 | A1 | 1/2003 | Andersen et al. | |
| 2007/0272587 | A1 | 11/2007 | Nguyen et al. | |
| 2009/0100802 | A1 | 4/2009 | Bush et al. | |
| 2011/0132797 | A1 | 6/2011 | Adair et al. | |
| 2011/0277419 | A1 | 11/2011 | Nicoletti | |
| 2011/0278192 | A1 * | 11/2011 | Thornton | B65D 73/0092 206/464 |
| 2011/0303738 | A1 * | 12/2011 | Foushee | B65D 5/48022 229/120.24 |
| 2013/0248587 | A1 | 9/2013 | Bouline | |
| 2016/0130022 | A1 | 5/2016 | Wissner | |

FOREIGN PATENT DOCUMENTS

| | | |
|---|---|---|
| DE | 102012103899 | 11/2013 |
| FR | 2595667 | 9/1987 |
| GB | 2258206 | 2/1993 |
| GB | 2478703 | 9/2011 |
| WO | 8606049 | 10/1986 |
| WO | 2007021788 | 2/2007 |
| WO | 2009015862 | 2/2009 |

OTHER PUBLICATIONS

English translation of the International Preliminary Report on Patentability dated Nov. 8, 2016 for corresponding PCT/EP2015/059832,11 pages.
International Search Report dated Sep. 14, 2015 for corresponding PCT/EP2015/059832, 3 pages.

* cited by examiner

METHOD FOR PACKAGING A PLURALITY OF CONTAINERS FOR SUBSTANCES FOR MEDICAL, PHARMACEUTICAL OR COSMETIC APPLICATIONS, AND PACKAGING STRUCTURE

RELATED APPLICATION

This application is a continuation of International Application No. PCT/EP2015/059832 filed on May 5, 2015, which claims priority of the German patent application no. 10 2014 106 197.7 "Method for packaging a plurality of containers for substances for medical, pharmaceutical or cosmetic applications, and packaging structure," filed on May 5, 2014, the whole content of which is hereby incorporated by reference.

FIELD OF THE INVENTION

The present invention relates generally to a packaging structure for storing and transporting a plurality of containers for storage of substances for medical, pharmaceutical or cosmetic applications, in particular of vials, ampoules or cartridges, and relates in particular to a method and packaging structure, whereby a high packing density of the containers and a simple and inexpensive processing of the containers can be accomplished.

BACKGROUND OF THE INVENTION

Medication containers, for example vials, ampoules or cartridges, are widely used as containers for preservation and storage of medical, pharmaceutical or cosmetic preparations to be administered in liquid form, in particular in pre-dosed amounts. These generally have a cylindrical shape and have a bottom or lower edge so that the containers can be placed perpendicular and upright on a flat surface. Such containers can be made of plastic or glass and are available in large quantities at low costs. In order to fill the containers under sterile conditions as efficiently as possible concepts are increasingly used according to which the containers are already packaged in a transport or packaging container at the manufacturer of the containers under sterile conditions, which are then unpackaged and further processed at a pharmaceutical company under sterile conditions, in particular in a so-called sterile tunnel.

For this purpose, various transport and packaging containers are known from the prior art, in which a plurality of medication containers are concurrently arranged in an irregular or regular arrangement, for example in a matrix arrangement along rows and columns extending perpendicular thereto. The regular arrangement has advantages in the automated further processing of the containers, because a glass-to-glass-contact of the containers can be prevented and because the containers can be transferred to processing stations at controlled positions and in a predetermined arrangement, for example to processing machines, robots or the like. However, the regular arrangement of the containers also has disadvantages, in particular because the maximum packing density (closest packing) of the containers cannot be accomplished.

U.S. Pat. No. 8,118,167 B2 discloses a transport and packaging container and a packaging concept, wherein the further processing of the containers is always performed in such a way that the supporting structure is first taken out the transport and packaging container and that the containers are then removed from the supporting structure and isolated and are transferred individually to the processing stations on a conveyor, in particular a conveyor belt, and further processed there. This limits the speed in the further processing that can be attained. Particularly during the isolation of the containers by means of cell wheels or the like, it always happens that individual containers abut uncontrollably, leading to an undesirable abrasion and consequently to contamination of the interior of the containers or of the processing station and to a deterioration of the outer appearance of the containers, which is undesirable.

GB 2478703 A discloses a supporting structure for supporting a plurality of vials for applications in gas or liquid chromatography. The supporting structure consists of two plates in which a plurality of receptacles are formed for accommodating the vials therein and which can be folded to each other for closing. The receptacles of the two plates are offset to each other so that the containers are stapled in order to double the packing density, but in order to enable a good access to the containers in the unfolded position.

US 20110132797 A1 discloses a transport container for vials for microbiological samples, consisting of a plurality of box-shaped segments, which can be plugged together to form the transport container. The vials are inserted into trough-shaped receptacles on the top of a respective segment and are disposed in an accommodating space formed by the segments when plugging together two adjacent segments. However, measures for sealing the interior are not disclosed.

FR 2595667 discloses a box-shaped container, into the lower segment of which a plurality of ampoules can be inserted, wherein the segment can be sealed against the environment by means of a cover that can be plugged on. However, measures for sealing the interior of the container are not disclosed.

US 20090100802 A1 discloses the use of a tray, wherein a direct glass-to-glass contact of the containers is prevented by means of rings on the bottom or also by means of an insert having receptacles for the containers. To further prevent a glass-to-glass contact of the containers, a sleeve enshrouding the transport container is used, in which a vacuum prevails, so that the sleeve is also pressed into the gaps between directly adjacent containers. Also with this concept, however, a maximum packing density of the containers in the transport container cannot be attained.

U.S. Pat. No. 3,537,189 discloses a transport assembly for a temporary storage of vials during freeze-drying. The transport assembly comprises a base, a frame inserted therein having no bottom and a box-shaped upper part. This transport assembly serves to ensure that the vials can be pushed directly onto the bottom of a freeze dryer by means of the frame. However, the vials are only accommodated in this transport assembly temporarily, but are not packaged therein.

U.S. Pat. No. 3,243,049 A discloses a similar transport assembly comprising a tray which is designed to be open on one side, and a frame inserted therein having a movable traverse bar, which serves for clamping the vials in the frame. By means of the frame, the vials are jointly inserted into the tray so as to be pushed into the freeze dryer finally.

Further packaging structures are disclosed in U.S. Pat. No. 8,100,263 B3 and US 20110277419 A.

SUMMARY OF THE INVENTION

It is an object of the present invention to provide a simple, cost effective and reliable method for packaging containers of the abovementioned type, which enables a high packing density of the containers and a simple and inexpensive further processing of the containers. Further, there is to be provided a corresponding packaging structure for a plurality of containers, wherein the same packaging structure preferably shall be suitable for containers of different shapes and dimensions.

According to the present invention there is provided a method for packaging a plurality of containers for substances for medical, pharmaceutical or cosmetic applications in a packaging structure, which comprises an upper part and a lower part and forms a box-shaped receptacle in which the containers are accommodated, the containers having a cylindrical side wall and a bottom or a lower edge extending perpendicularly to the side wall thereof, comprising the steps of: disposing the plurality of containers directly on a flat surface so that the containers are supported or rest perpendicularly on the flat surface; inserting the plurality of containers into the upper part or into the lower part of the packaging structure by sliding the plurality of containers on the flat surface into the upper part or lower part and by placing the upper part on the upper ends of the containers, wherein the upper part is box-shaped and the lower part is flat (e.g. is formed at least in sections as a plate) or box-shaped; and sealing the packaging structure comprising the upper and lower part and the containers accommodated therein by insertion into a sleeve or re-sealable bag of a plastic material or by means of a gas-permeable plastic foil; wherein side walls of the upper part and/or lower part projecting perpendicularly from the base of the lower part and/or of the upper part serve as guiding devices during the insertion of the plurality of containers into the upper part or lower part.

Thus, the packaging structure can be assembled of a few simple parts and is therefore inexpensive and easy to handle. The containers can be inserted into the packaging structure simply by sliding on a supporting surface without the necessity of additional complicated intermediate steps, such as isolation or gripping of the containers. Here, side walls of the upper part and/or lower part can be used simultaneously as lateral guiding devices for guiding the containers upon insertion into the upper part and/or lower part, which automatically allows for a precise guidance of the containers in correspondence to the packaging structure subsequently formed and helps to save further efforts when handling of the containers.

The arrangement or array of the containers in the packaging structure can be defined particularly by the geometry of the box-shaped lower part and/or upper part. For example, if a rectangular arrangement of a plurality of containers in m rows and n columns, extending perpendicularly, is desired, at a known outer diameter of the containers, the clearance between the side walls or between the front walls and rear walls of the lower or upper part simply needs to correspond exactly to the m-fold or n-fold maximum outer diameter of the containers in order to implement a supporting of the containers free of clearance and without the possibility of a displacement of the containers relative to each other and relative to the side walls of the lower or upper part, when the side walls themselves are formed of a non-elastic material. In a corresponding manner the geometry of the box-shaped lower part and/or upper part may also be specified if the containers shall be arranged in the packaging structure for example in a hexagonal close-packed (hcp) positioning.

Because open ends of the containers at their upper and/or lower ends are possibly directly covered by means of the upper and/or lower part or by means of an intermediate part, the intrusion of disturbing particles into the containers in the packaging structure during a temporary storage or handling of the containers or during the transport of the containers can be prevented. It may be sufficient for this purpose, if the intermediate part is formed by a flat plate or foil. Conveniently, however, the intermediate part comprises, at least in sections, vertically projecting side walls preventing a lateral slippage of the intermediate part from the containers.

Further, according to the present invention a sterile and aseptic packaging of the containers is possible in a simple manner by additionally packaging and sealing the packaging structure comprising the upper and lower parts and the containers accommodated therein by insertion into a sterile sleeve or into a re-sealable bag made of a plastic material or by means of a gas-permeable plastic foil. Even then, the packaging structure can be sealed and re-opened quickly and at low costs. Preferably, the sleeve or sealable bag or the gas-permeable plastic foil enables sterilizing the containers while these are accommodated in the packaging structure. To this end one or more perforations or through-holes may be provided in the upper part and/or lower part at a suitable position through which a gas can flow for sterilizing the containers. For sealing the packaging structure, the gas-permeable plastic foil may also be selectively bonded directly only to those parts of the packaging structure, which are provided with the perforations. Or the sleeve or re-sealable bag is formed like a hood and is made of a gas-permeable plastic foil, as described below, which is suitably connected to the structure formed by the upper and lower parts to form the packaging structure.

According to a further embodiment, the upper part and/or the lower part are configured and provided in such a way that the containers are in a direct contact with each other in the box-shaped receptacle and cannot be displaced relative to each other. In contrast to the prior art, according to which a direct contact of the containers is prevented by complicated supporting structures for hygienic and aesthetic reasons, according to the present invention there exists a direct contact of the containers with each other in the box-shaped receptacle. According to the invention, however, this is implemented in such a way that the containers permanently contact each other and cannot be displaced relative to each other during storage, transport and handling of the packaging structure. In this surprisingly simple manner, according to the present invention also undesired scratches and the intrusion of particles due to material abrasion from the side walls of the containers can be reliably prevented. For this purpose, it is advantageous if the containers have a cylindrical and smooth side wall, without any protrusions in the circumferential direction.

Because the containers are in a direct contact with each other in the packaging structure, further a maximum packing density of the containers can be implemented which offers considerable economic advantages. Here, depending on the manner of their positioning on the lower part, the containers can be positioned on the lower part in rows and columns extending perpendicularly thereto or in rows extending in mutually diagonal directions. However, in general the containers may be arranged in any other arrangement, in particular in so-called close packings, such as a hexagonal close-packing (hcp) or trigonal close-packing (tcp). The containers may also take these close packings automatically when loading the packaging structure, e.g. when they are pushed from a conveyor belt or the like into a box-shaped lower or upper part, without requiring additional positioning means.

According to a further embodiment, the containers are disposed on the bottom of the lower part or on a flat surface between at least three side walls of the lower part in an arrangement of a shape, which corresponds to the shape of the box-shaped receptacle formed by the packaging structure, if viewed in a plan view. If the side walls of the lower part are not yet connected to each other, they can then be connected with each other in a subsequent step to form the box-shaped receptacle. Subsequently, also the upper part may be placed directly on the upper ends of the containers in the box-shaped receptacle of the lower part in order to complete the packaging structure.

Alternatively, the containers are disposed between at least three side walls of an accommodation jig on the lower part or on a flat surface in such a manner that the geometry and arrangement of the containers is defined by the side walls of the accommodation jig. Thus, after removal of the accommodation jig a gap is formed along the side edges of the array of containers into which the side walls of the upper part engage when placing the upper part on the upper ends of the containers or into which a pusher may engage for displacement of the containers into the packaging structure.

According to a further embodiment, the containers may also be displaced by means of a pusher which engages into the gaps between the containers, for example, row-wise by means of a strip-shaped pusher.

According to a further embodiment, the upper part placed onto the upper ends of the containers, or alternatively also a corresponding box-shaped intermediate part, may be used to push the containers from a flat surface on which they were initially stored and suitably located, for example from a conveyor belt or from a supporting surface, onto the bottom of the lower part of the packaging structure. When moving the containers the geometry and arrangement of the containers is reliably maintained.

For the aforementioned pushing of the containers into the lower part it is of advantage, if at least one front and/or rear side wall of the lower part is removed or at least opened, in particular folded downward or folded laterally, to such an extent that the upper side of the bottom of the lower part is flush with the upper side of the supporting surface which is disposed laterally and on which the containers were placed previously in the desired geometrical arrangement, particularly on a conveyor belt disposed laterally, from which the containers are pushed into the lower part.

According to a further embodiment, front side tabs of the lower part can be secured in an unfolded position and a front side wall and/or a rear side wall of the lower part is/are secured in a folded-down position when the containers are pushed onto the bottom of the lower part. This can be accomplished by means of suitable folding of material sheets from which the lower part is formed by folding, or by means of suitable positive-locking structures or frictional structures on the front side tabs of the lower part and on the front side wall and/or rear side wall of the lower part. Thus, the containers can be freely pushed into the lower part, since interfering side walls of the lower part can be temporarily held back.

According to a further embodiment, instead of the box-shaped upper part, first a box-shaped intermediate part having a bottom and side walls projecting perpendicularly therefrom is placed on the upper ends of the containers and the box-shaped upper part is placed on the intermediate part only at a final stage to complete the packaging structure. The intermediate part reliably prevents the intrusion of particles into the containers via openings at their upper ends at each stage of the handling of the containers and can also be used for pushing the containers in the manner described above.

According to a further embodiment, the bottom of the upper part and/or of the lower part and/or the side walls of the upper part and/or of the lower part has perforations, which are sealed by means of a gas-permeable plastic foil at an appropriate stage of the process, in particular by a mesh made of synthetic fibers such as polypropylene fibers (PP) or a Tyvek® protective film. This gas-permeable plastic foil may also be added subsequently, for example it may be bonded on the edges of the perforations. Thus, a sterile and aseptic packaging of the containers in the packaging structure is accomplished. Sterilization of the containers may also be accomplished within the packaging structure by providing a gas for the sterilization of the containers that flows from outside via the plastic foil and the box-shaped receptacle of the packaging structure into the interiors of the containers. An ethylene oxide gas named ETO may be used as a sterilizing gas. Ethylene oxide gas kills bacteria, viruses and fungi, and hence can be advantageously used for the fumigation of heat-sensitive substances. As an alternative gas, formaldehyde or a hydrogen peroxide vapor named VHP may be used. Hydrogen peroxide acts as a sterilizing agent, may be produced in an advantageously simple and cost-effective manner by active evaporation of an aqueous hydrogen peroxide solution and thus may be used to sterilize the outer region of the bag. In order to achieve a high biological decontamination rate of the microorganisms, a defined high concentration of >5% to 50% is required. Finally, the packaging structure may be sealed additionally in a tube (sleeve) or placed in a bag that can be sealed.

According to a further embodiment, a hood made of the gas-permeable plastic foil may be placed on the upper or lower part, which is connected circumferentially with an edge of the upper or lower part by means of adhesive bonding or heat sealing, wherein the gas-permeable plastic foil is in particular a mesh made of synthetic fibers, for example, of polypropylene fibers (PP), or a Tyvek® protective film, as explained above.

According to a further embodiment, the lower part and the upper part may be detachably connected with each other, in particular latched to one another. In this embodiment the containers may be held reliably in the packaging structure without a front and/or rear side wall of the lower part or of the upper part.

According to a further embodiment, the lower part and the upper part may be detachably connected with each other by positive-locking or by friction, in particular by clamping.

For a detachable connection, according to a further embodiment guiding structures may be used which extend in the longitudinal direction of the lower part along side walls of the lower part and which are guided by side walls of the upper part during the insertion of the lower part into the upper part. In particular, these guiding structures may be of a rectangular design in profile and may be accommodated by positive locking or friction by correspondingly shaped side wall portions of the upper part, in particular by clamping.

According to a further aspect of the present invention, there is provided a packaging structure having a corresponding design. This is preferably used for storage, stocking, also for temporary stocking during handling or processing of containers, and for the transport of containers for substances for medical, pharmaceutical or cosmetic applications, in particular of vials, ampoules or cartridges.

According to a further embodiment, the lower part may advantageously consist of a material or be provided with a slide coating having a coefficient of friction with respect to the material of the container, in particular with respect to glass, of less than 0.6. The material or the slide coating may consist of a polymer and an adhesion promoter layer. In such an embodiment, the containers can be inserted reliably into the packaging structure with an advantageously low force.

According to a further embodiment, the side walls of the lower part and/or of the upper part are of an elastic design, so that the containers are accommodated in the box-shaped receptacle to be biased against each other and so that a slippage of the containers relative to each other and relative to the side walls of the lower part or upper part is prevented in a simple manner. The biasing of the containers may also be relatively weak as a result of the design of the side walls of the lower part and/or of the upper part and is in any case substantially below a maximum load that would lead to breakage or damage of the side walls of the containers in the packaging structure. The dimensions of the side walls of the lower part and/or of the upper part can be set such that they need to be widened slightly for insertion of the containers into the box-shaped receptacle formed by them. Alternatively, the side walls may also be connected with each other only after the placing of the containers in the desired arrangement and with elastic biasing relative to each other to form the respective box-shaped receptacle.

For this purpose releasable connection types may be used, such as folding and nesting of side wall portions, but also non-releasable connection types may be used, such as riveting or adhesive bonding.

According to a further embodiment additionally or alternatively an insert is formed within the box-shaped receptacle of the packaging structure, which is of an elastic design at least in sections, so that the containers are accommodated and biased against each other elastically in the box-shaped receptacle in the manner described above and so that a slippage of the containers relative to each other and relative to the side walls of the lower or upper part is prevented.

According to a further embodiment the side walls of the lower part and/or of the upper part and/or of the aforementioned insert are provided at least in sections from a thermoplastic, thermosetting or elastomeric plastic material, which is foamed or formed as a twin-walled sheet with hollow chambers. Such plastic materials are available at low costs, may be produced and processed easily with the desired dimensions and elastic characteristics and enable a sterile, aseptic packaging of the containers.

For completing the packaging structure, according to a further embodiment a hood of the gas-permeable plastic foil is placed on the upper part or lower part, which is circumferentially connected to an edge of the upper or lower part, in particular by means of adhesive bonding or heat sealing, wherein the gas-permeable plastic foil is particularly a mesh made of synthetic fibers such as polypropylene fibers (PP) or a Tyvek® protective film, as set forth above. For sterilizing the containers accommodated in the packaging structure, a gas may flow via the gas-permeable plastic foil and via corresponding apertures or perforations in the upper or lower part and, if necessary, in the above-mentioned intermediate part.

OVERVIEW ON DRAWINGS

Figure 1B:
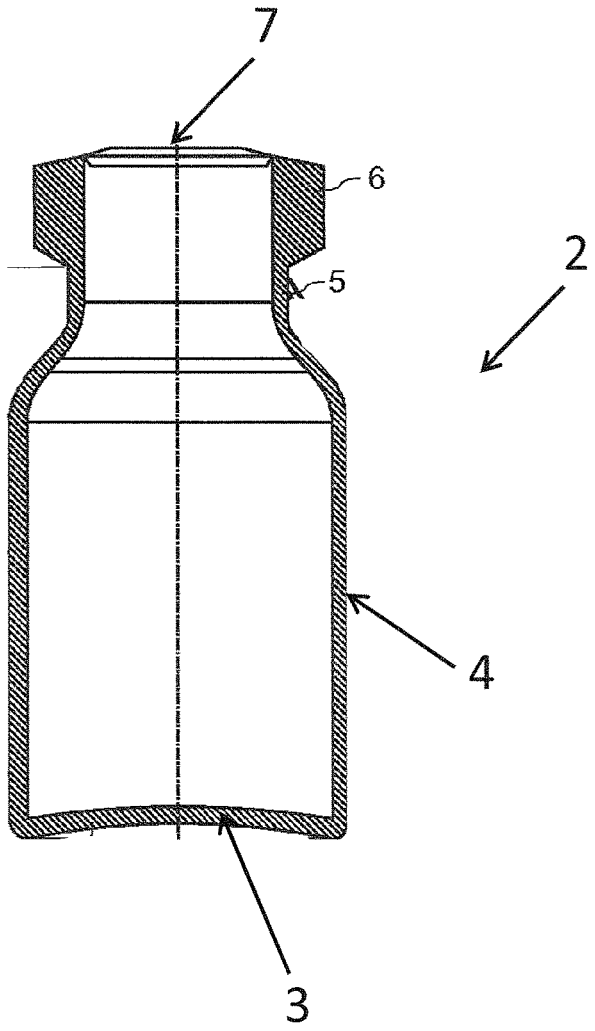

The invention is described by way of example and with reference to the accompanying drawings, from which further features, advantages and problems to be solved will become apparent. In the drawings:

FIG. 1*a* shows a packaging structure according to a first embodiment of the present invention in a schematic view before its completion;

FIG. 1*b* is an example of a container for use in a packaging structure according to the present invention;

FIGS. 2*a*-2*d* show the steps for producing a packaging structure as shown in FIG. 1*a*.

FIGS. 3*a*-3*h* show the steps for producing a packaging structure according to a further embodiment of the present invention;

FIGS. 4*a*-4*d* show further details of the packaging structure according to FIGS. 3*a*-3*h;*

Figure 6A:
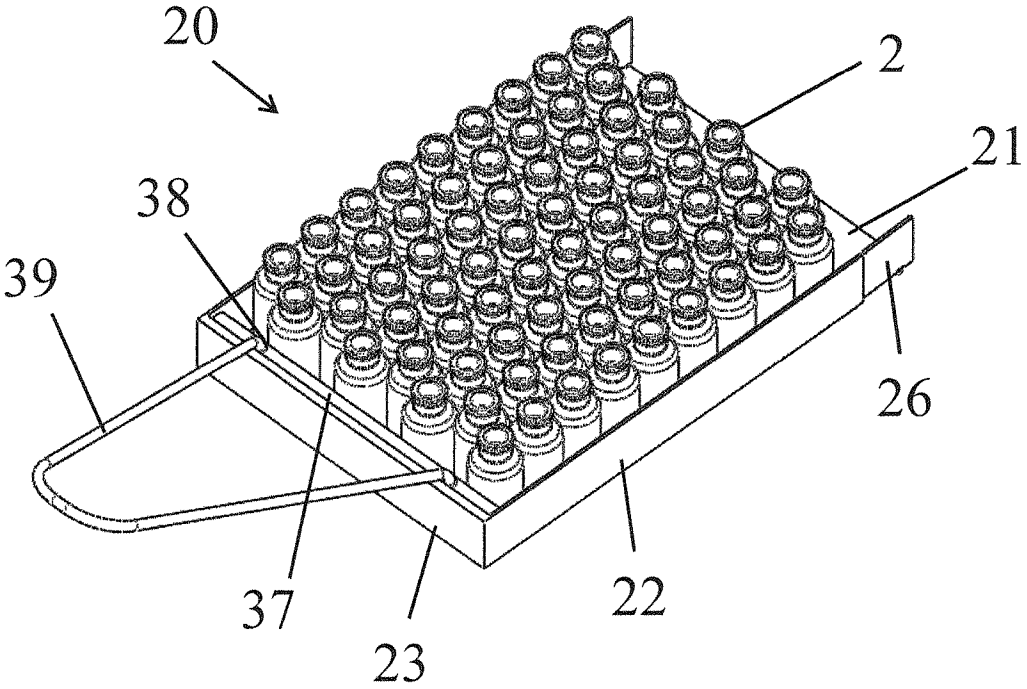
Figure 6B:
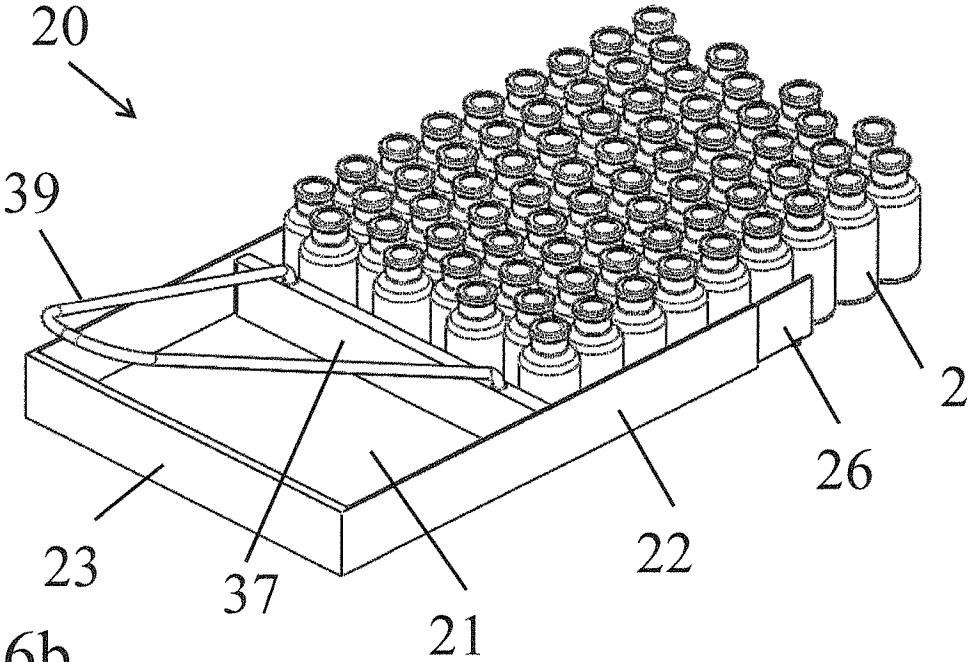
Figure 6C:
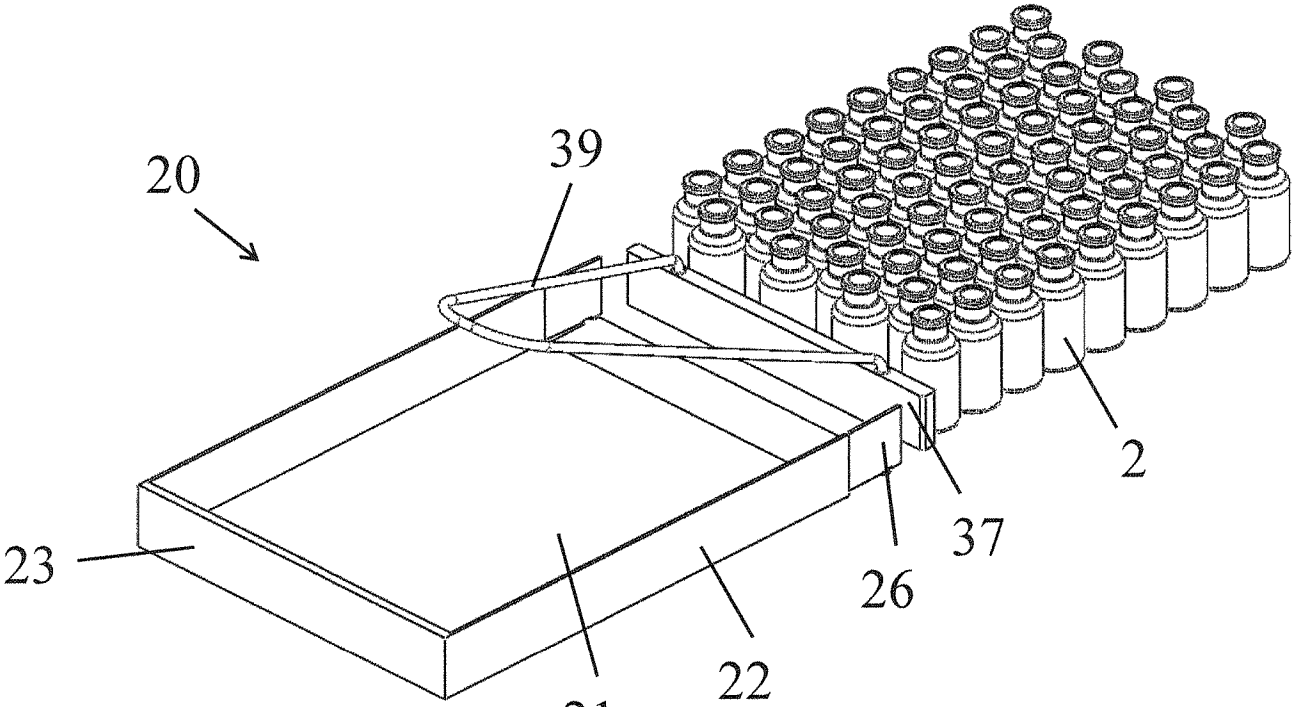
Figure 8A:
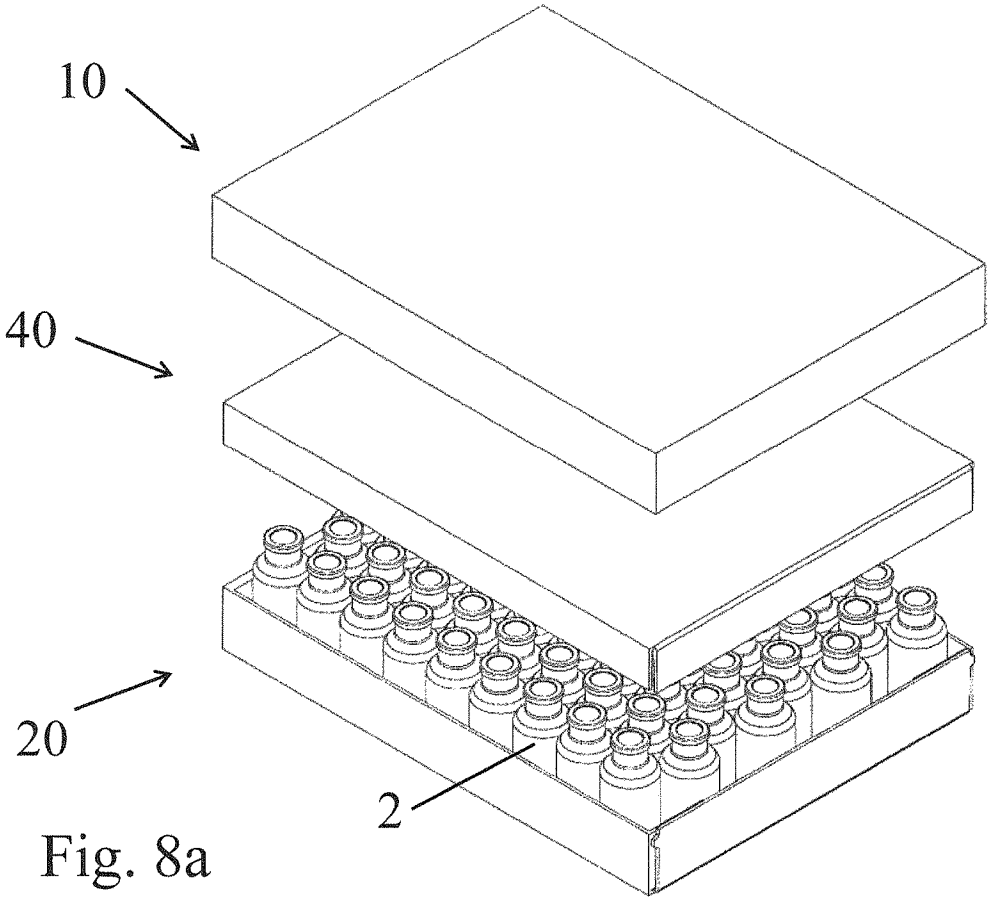
Figure 8B:
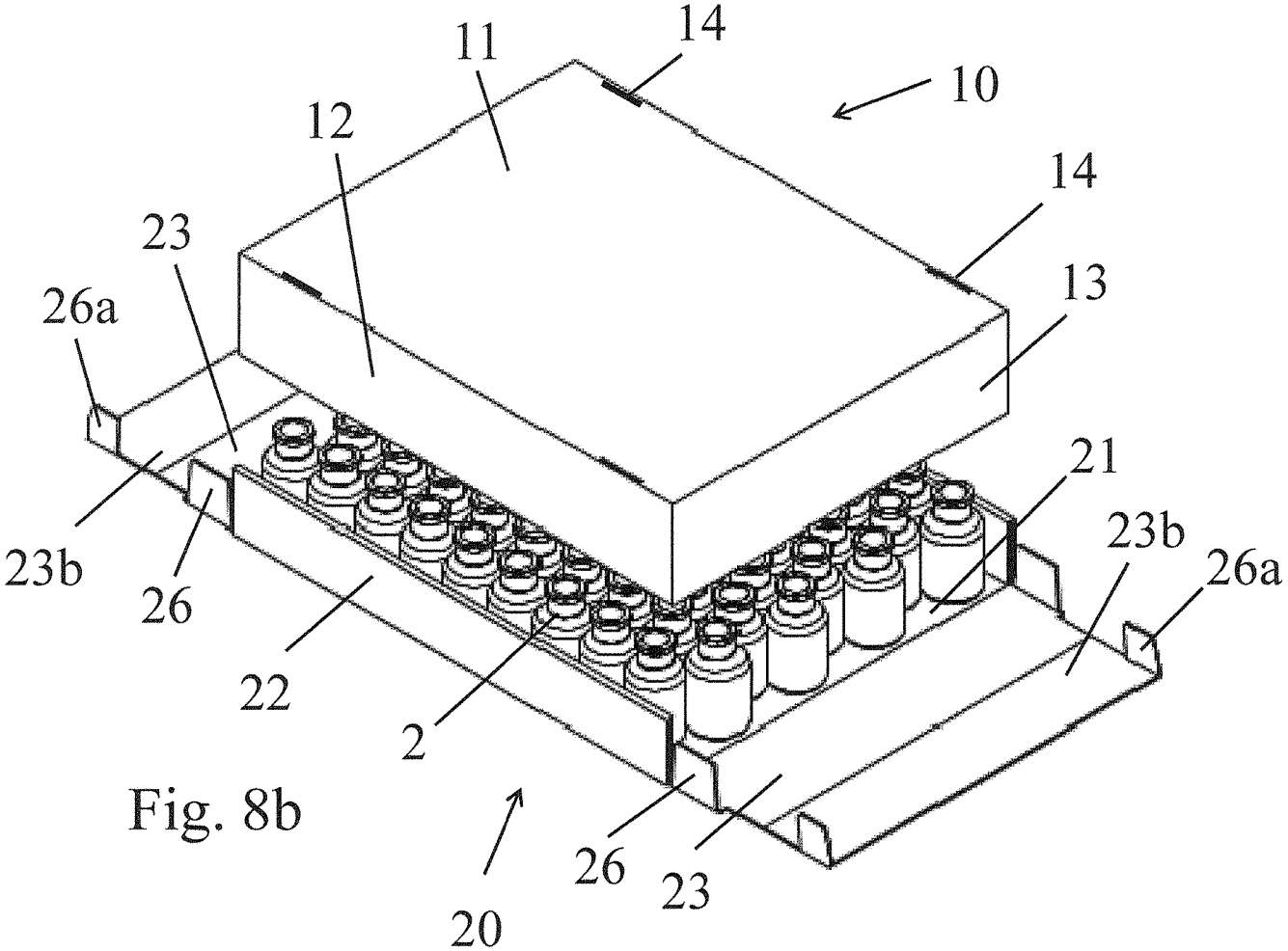
Figure 8C:
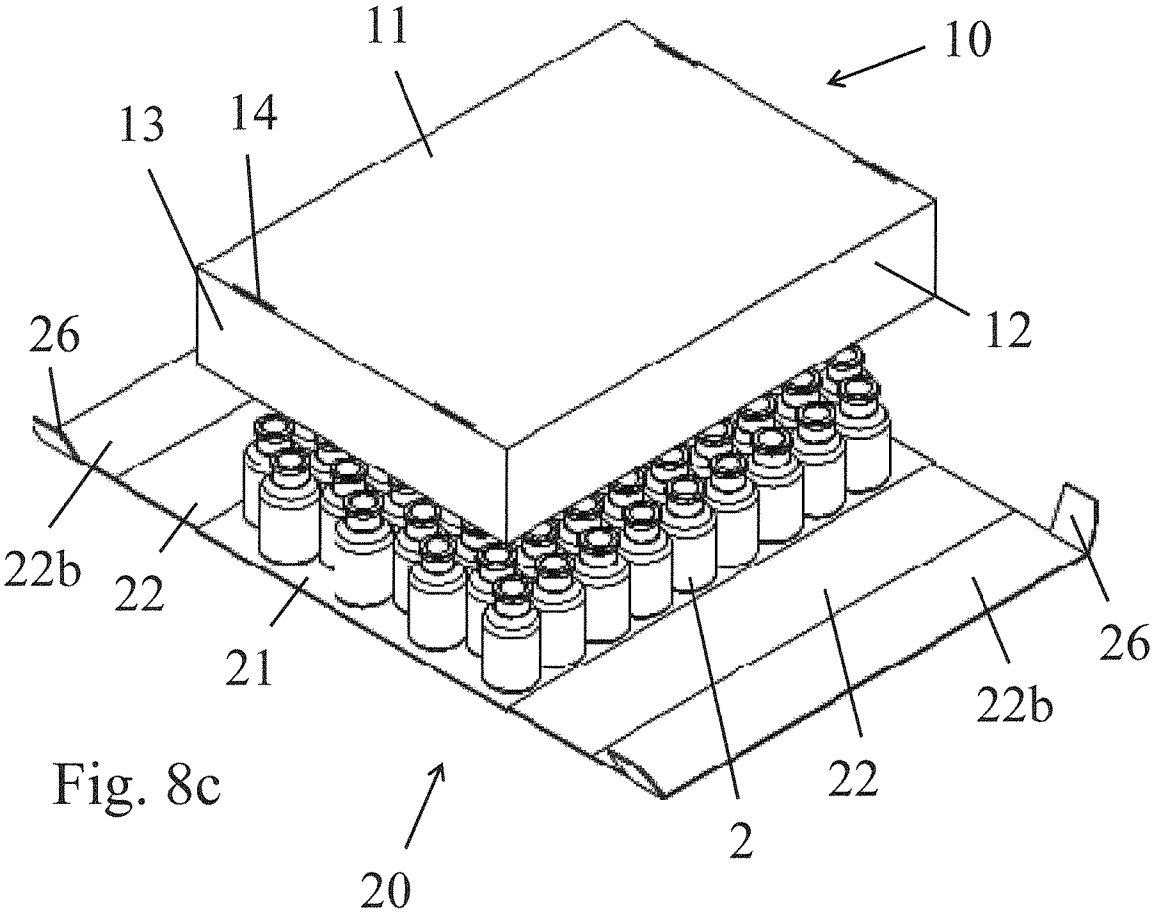
Figures 9A, 9B:
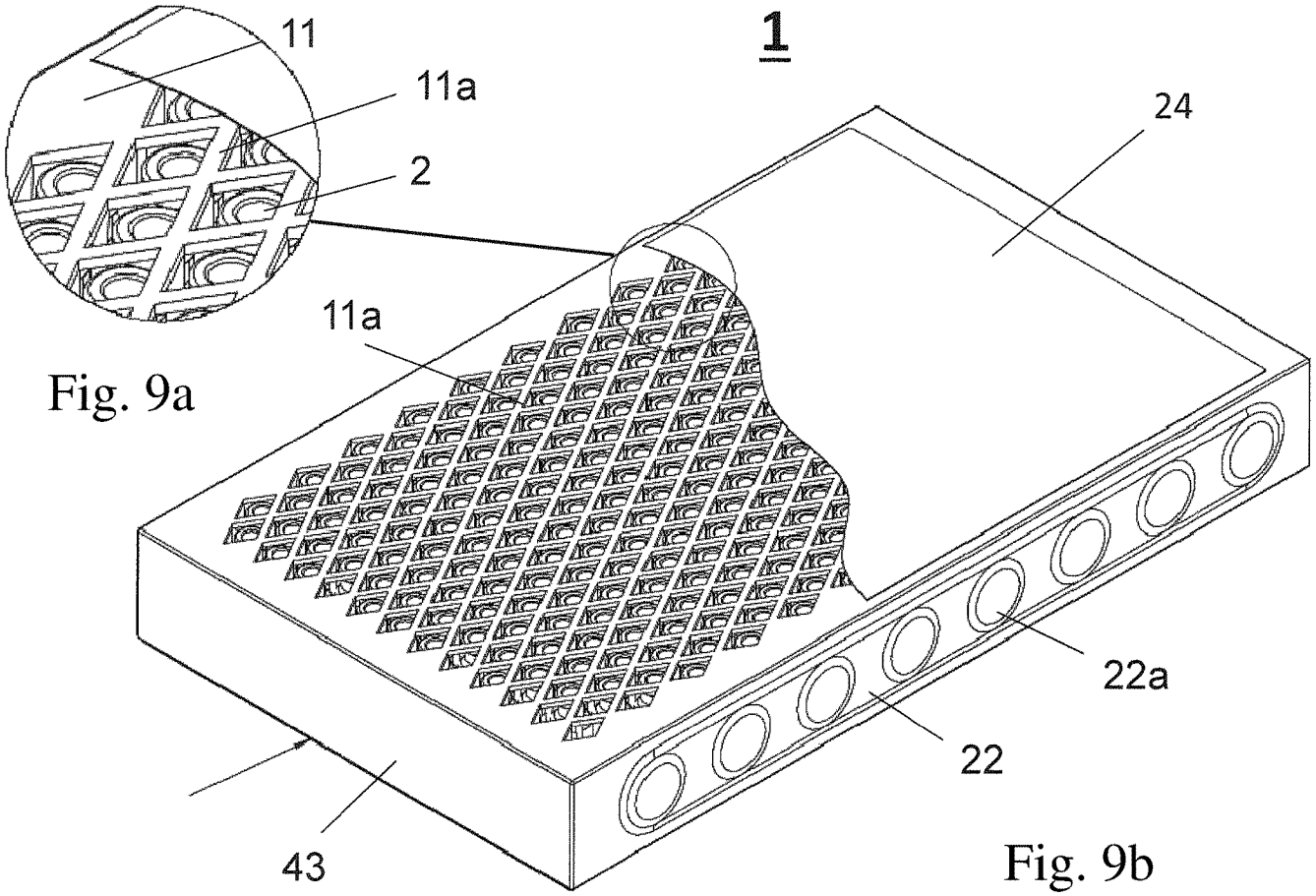
Figure 12A:
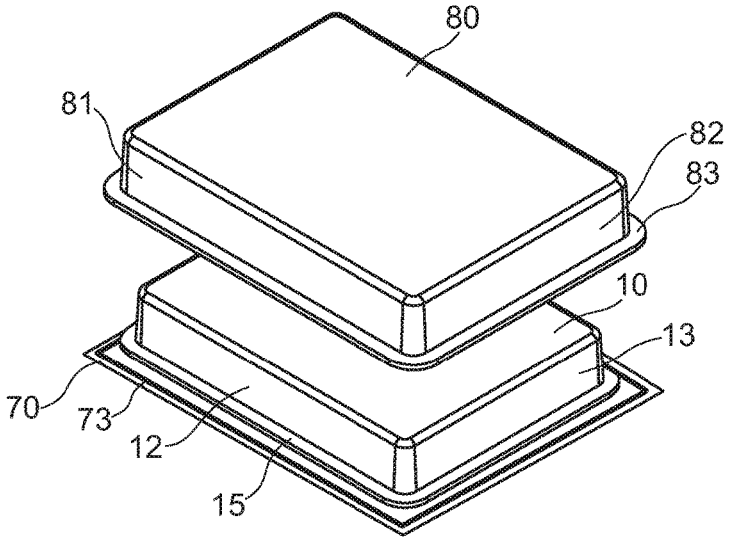
Figure 12B:
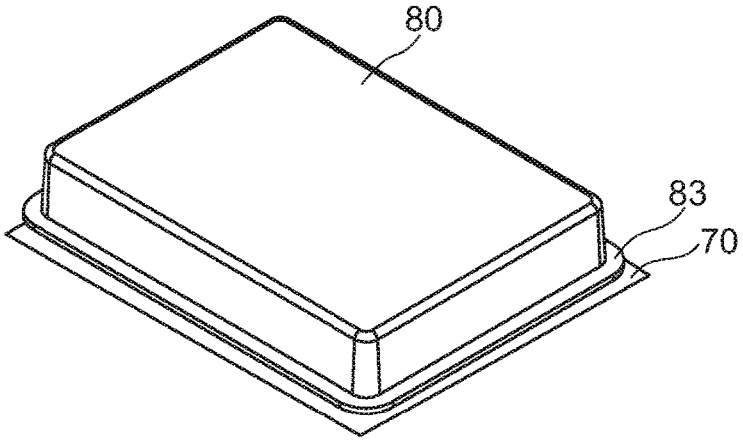
Figure 12C:
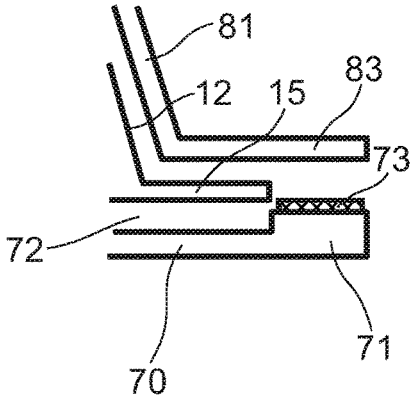
Figure 12D:
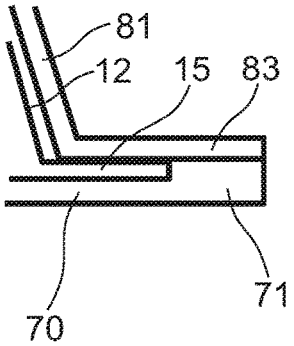
Figure 13:
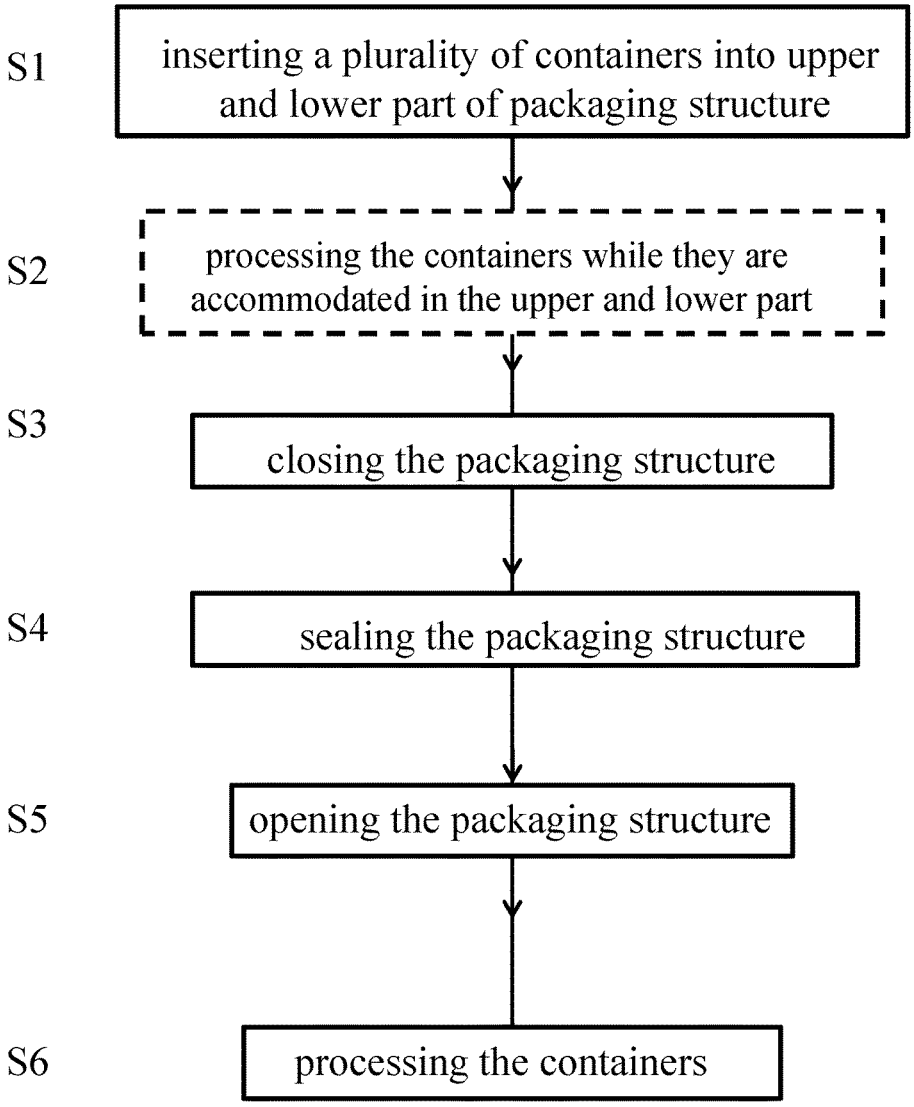

FIGS. 5*a*-5*f* show details upon opening a packaging structure according to a further embodiment of the present invention;

FIGS. 6*a*-6*c* show the steps for producing a packaging structure according to a further embodiment of the present invention;

FIGS. 7*a*-7*d* show details of a packaging structure according to a further embodiment of the present invention;

FIGS. 8*a*-8*c* show details of packaging structures according to further embodiments of the present invention;

FIGS. 9*a*-9*b* show a packaging structure according to a further embodiment of the present invention;

FIGS. 10*a*-10*d* show details of a packaging structure according to a further embodiment of the present invention;

FIGS. 10*e*-10*h* show details of a packaging structure according to a further embodiment of the present invention;

FIGS. 11*a*-11*e* show details of a packaging structure according to a further embodiment of the present invention;

FIGS. 12*a*-12*d* show details of a packaging structure according to a further embodiment of the present invention; and FIG. 13 is a schematic flow diagram of a method for producing a packaging structure according to the present invention.

In the drawings, identical reference numerals designate identical or substantially equivalent elements or groups of elements.

DETAILED DESCRIPTION OF PREFERRED EMBODIMENTS

FIG. 1 shows a packaging structure according to a first embodiment of the present invention in a schematic view before its completion. The packaging structure 1 comprises a box-shaped upper part 10 and a box-shaped lower part 20, which is shown in FIG. 1*a* in a partly finalized state. The upper part 10 has a flat, rectangular bottom 11 and two side walls 12 and a front and rear side wall 13, each projecting perpendicularly from the bottom 11. The lower part 20 is formed in a corresponding manner and has a flat, rectangular bottom 21 and two side walls 22, each projecting perpendicularly from the bottom 21. The front and rear side wall 23 is shown in FIG. 1*a* still folded down and forms a common plane (flat surface) together with the bottom 21 and is folded upward at a later stage for forming a box-shaped lower part.

Because according to FIG. 1*a* the front side wall 23 is folded down, the containers 2 can be pushed easily into the lower part 20 from a shelf (not shown), which is preferably flush with the top surface of bottom 21 and of the front side wall 23 that is folded down. Upon insertion of the containers 2 into the lower part 20 the side walls 22 serve as lateral guiding devices. After the containers are arranged in the lower part 20, the side lugs 26, which are formed at the front ends of the side walls 22, and the front side wall 23 are turned over and connected to each other to form a front side wall, which also protrudes perpendicularly from the bottom 21 of the lower part 20. In this state, a box-shaped receptacle is formed by the side walls 22 and the front and rear side wall 23 of the lower part, in which the containers 2 are accommodated. The height of the side walls 22, 23 is less than the height of the containers 2.

FIG. 1*b* shows a vial 2 as an example of a container for which a packaging structure according to the present invention is suited. The vial 2 has a cylindrical basic shape, having a cylindrical side wall 4 with—within tolerances—a constant inner and outer diameter, which projects vertically from a flat vial bottom, which merges in a constricted neck portion 5 of a relatively short axial length near the upper open end of the vial and then merges in an expanded upper rim 6, which has a larger outer diameter than the associated neck portion 5 and is configured for connection to a closure member. The neck portion 5 may be formed with smooth walls and without an external thread or may be provided with an external thread for screwing on a closure member. For example, a stopper (not shown) may be inserted in the inner bore of the neck portion 5 and of the upper rim 6, whose upper end is connected with the upper rim 6 of the vial in a gas-tight manner and protected against the intrusion of contaminants into the vial, for example by crimping or beading a metal protective foil which is not shown. Such vials are radial symmetric and are made of a transparent or colored glass or of a suitable plastic material by blow molding or plastic injection molding techniques, and in general can be internally coated so that the material of the vial emits minimal impurities to the agent to be accommodated.

Further examples of a medication container in the sense of the present application are ampoules, carpoules (cartridges) or syringes or injection containers.

In the sense of the present invention, such containers are used for the storage of substances or agents for medical, pharmaceutical or cosmetic applications, which are to be stored in one or several components in solid or liquid form in the container. Especially in the case of glass containers storage periods can amount many years, notably depending on the hydrolytic resistance of the glass type used. While, in the following, cylindrical containers are disclosed, it should be noted that the containers, in the sense of the present invention, may also have a different profile, for example a square, rectangular or polygonal profile. If containers 2 in the sense of the present invention do not have a substantially flat bottom 3, in any case a circumferential edge is formed at a height of the container 2 so that the containers can be displaced on a supporting surface, if these are supported vertically on the supporting surface.

According to FIG. 1*b*, the bottom 3 or the lower edge of the side wall 4 extends exactly perpendicular to the side wall 4 of the container 2 so that the container 2 is arranged exactly vertically upright on the bottom 21 of the lower part 20 (see FIG. 1*a*). This prevents excessive forces acting on the side walls of the containers, which could lead to scratches, abrasion of material or even a bursting of the containers, even if the containers 2 are supported so as to be biased or clamped against each other.

As shown in FIG. 1*a*, the containers 2 are accommodated in the lower part 20 with direct wall-to-wall contact so that the greatest possible packing density can be achieved. According to further embodiments inserts may be provided between all containers, for example in the form of partition walls, which prevent a contact of the directly adjacent containers in the lower part or in the subsequent packaging structure. According to further embodiments, such partition walls may also be provided as partition strips partitioning rows of containers from each other. As explained below, such partition walls or partition strips may also be used for displacement of the containers on a flat surface.

Figure 2B:
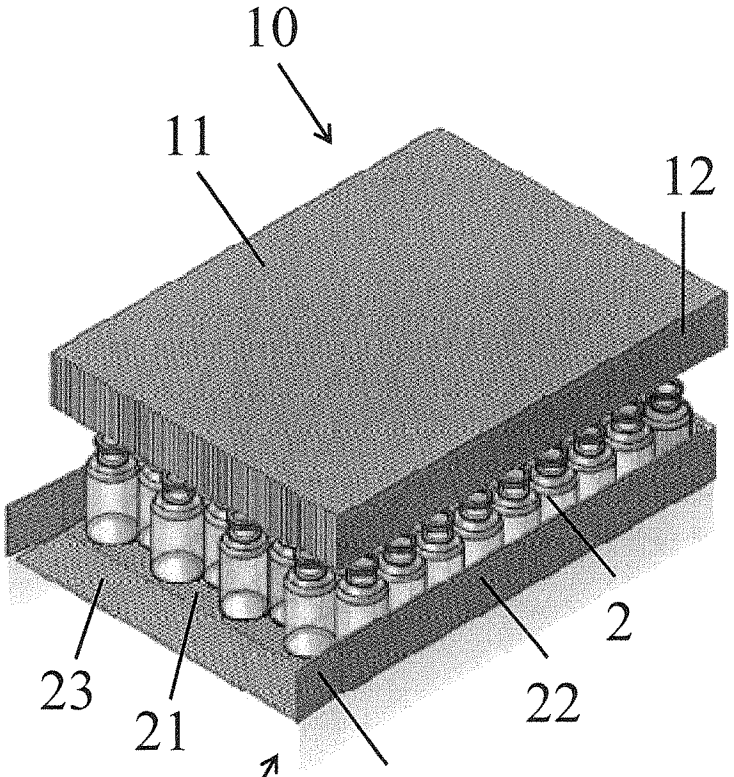
Figure 2A:
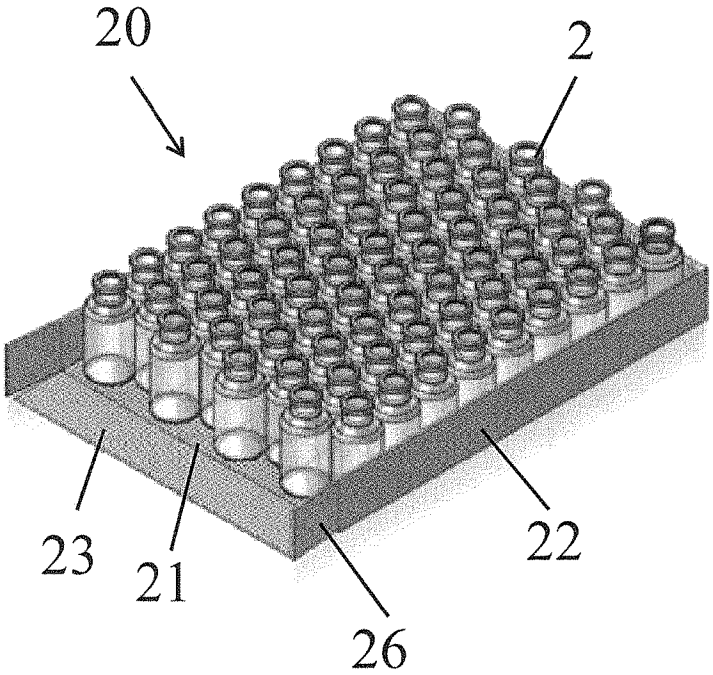
Figure 2D:
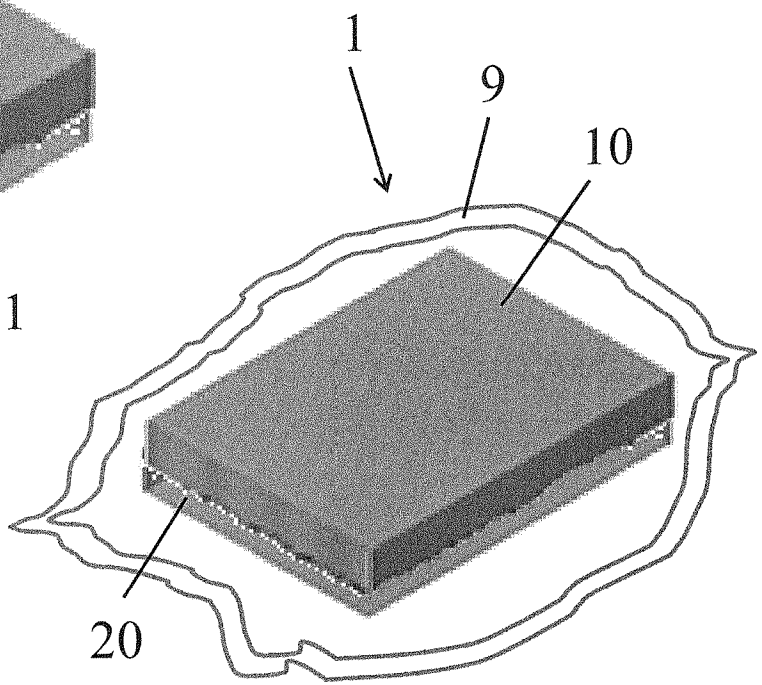

FIG. 2*a* shows the lower part according to FIG. 1*a*. After insertion of the containers 2 into the lower part 20 and closing of the lower part 20 by folding the front side wall 23 and the side lugs 26 (not shown in FIG. 2*b*), according to FIG. 2*b* the box-shaped upper part 10 is placed directly onto the upper ends of the containers 2. Of course, also an intermediate layer, for example, a thin plastic plate or plastic foil, may be placed on the upper ends of the container 2 before the upper part 10 placed on.

Figure 2C:
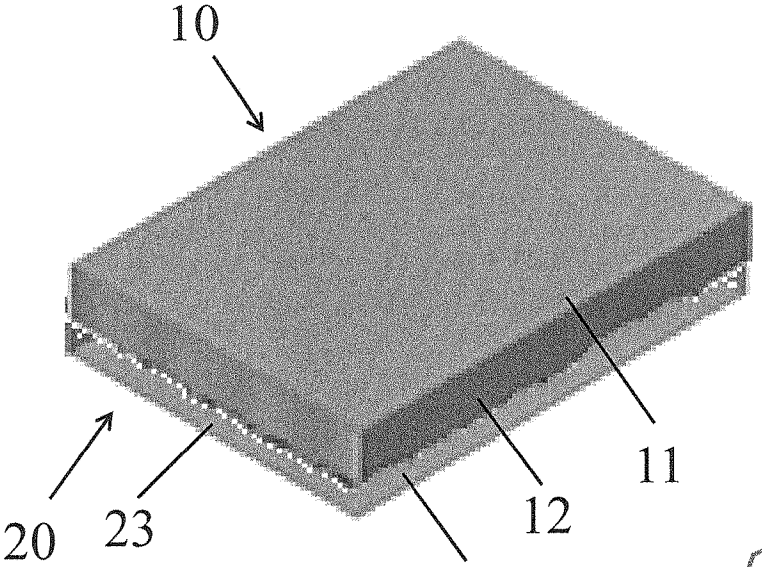

In this way finally the packaging structure shown in FIG. 2*c* is formed. Finally, the packaging structure 1 thus formed is sealed in a tube or sleeve 9 made of a plastic material or placed in a plastic bag that may be sealed and is from a plastic material, in which the containers are accommodated sterile and aseptically packaged (see FIG. 2*d*).

The containers are preferably accommodated in the lower part or in the upper part of the packaging structure 1 without play, i.e. they are accommodated therein in such a manner that they cannot be displaced, neither relative to each other nor relative to the side walls or bottoms of the lower and upper part. For this purpose, a clamping (mechanical biasing) of the containers in the box-shaped receptacle of the packaging structure 1 is not mandatory. Rather, the box-shaped receptacle of the lower part and/or of the upper part may also be mated to the arrangement of the containers—assuming a direct wall-to-wall contact of all containers—so precisely that any relative displacement of the containers relative to each other is excluded.

According to a preferred embodiment, the containers may be accommodated in the box-shaped receptacle of the lower part and/or of the upper part in a clamped state (a permanent mechanical, elastic biasing against each other). For this purpose, an elastic insert may be inserted into the lower part and/or upper part, which biases the containers accommodated therein permanently, so that they are held clamped in the packaging structure. Such an elastic insert may extend, for example, like the strip-shaped insert 38 shown in FIG. 6*a* along a side wall of the lower part and/or of the upper part. Alternatively, the side walls of the lower part and/or of the upper part may be formed at least in sections from an elastic material, wherein the side walls are stretched or elongated during insertion of the containers into the lower part and/or upper part and the force required for this purpose is then released again so that the side walls seek to return to their initial position, namely until they get in contact with the arrangement of containers accommodated in the lower part and/or upper part and these are held clamped. As another alternative, partition walls or partition strips may be inserted between all containers or between rows of containers as an insert of an elastic material, which permanently biases the containers accommodated in the packaging structure against each other so that they are held clamped.

Such partition walls or separating strips may also be used for pushing the containers when forming the packaging structure according to the present invention, e.g. for displacing entire rows of containers, as explained below.

Figure 3A:
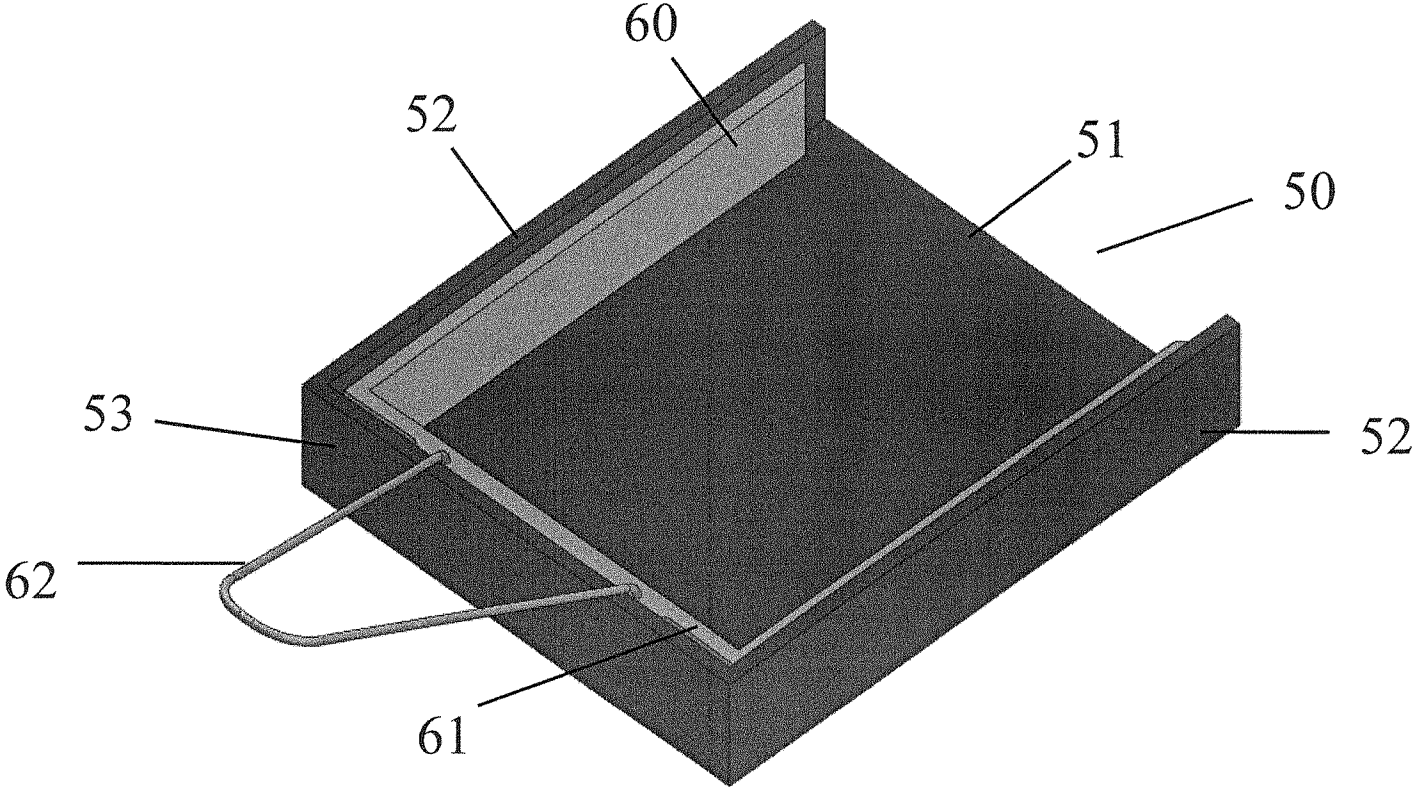

FIGS. 3*a*-3*h* illustrate the steps of forming a packaging structure according to a further embodiment of the present invention. FIG. 3*a* shows an accommodating jig 50 in which the containers are to be disposed in a desired arrangement in advance before they are pushed in this arrangement into the lower or upper part or before they are accommodated therein. For this purpose, the accommodating jig 50 shown in FIG. 3*a* comprises a flat bottom 51 (flat surface), wherein the two mutually parallel side walls 52 and a rear wall 53 each project perpendicularly. The side walls 52 and the rear wall 53 together form a box-shaped receptacle having an open front end. A U-shaped spacer is inserted into the accommodating jig 50, which consists of two mutually parallel side walls 60 and a rear wall 61.

Figure 3B:
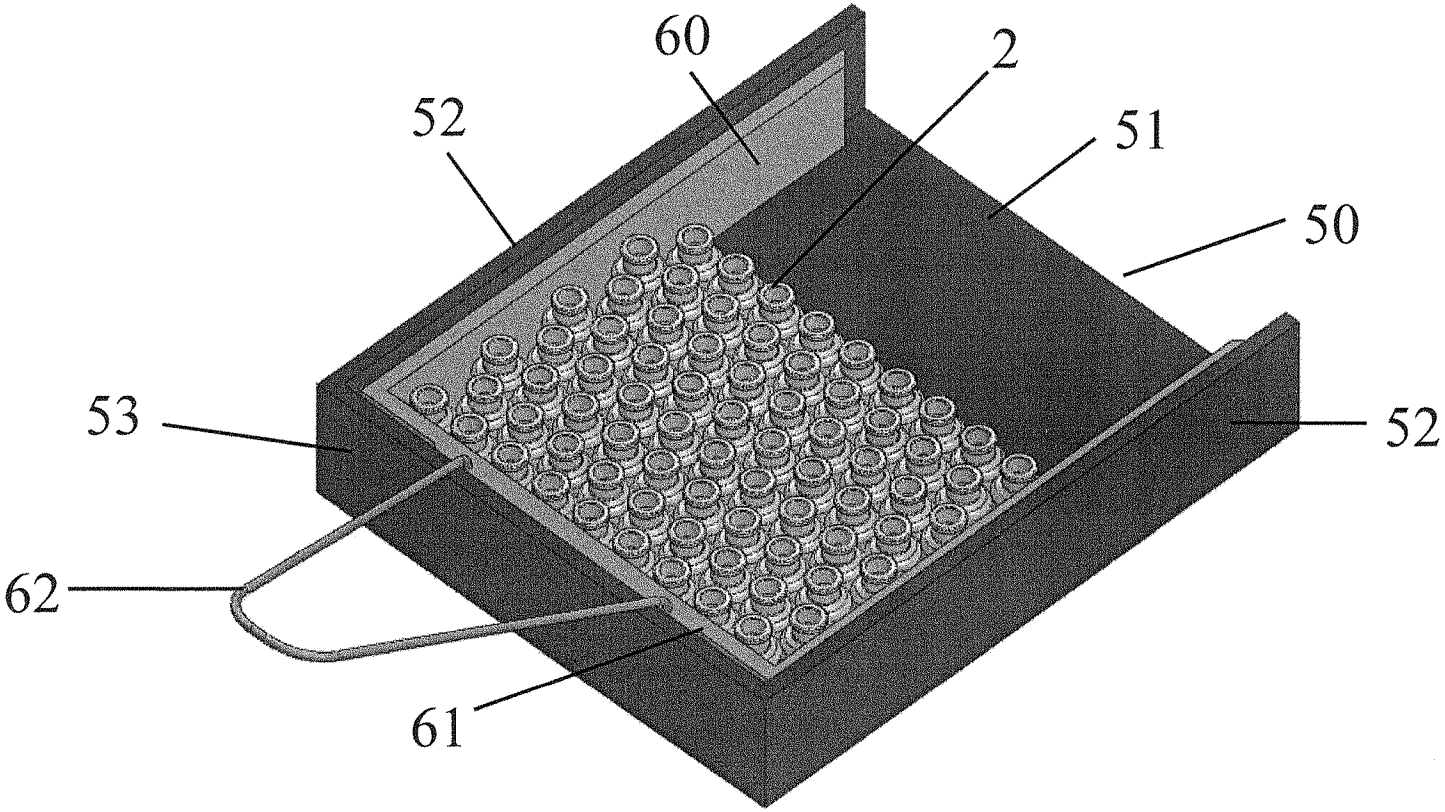

According to FIG. 3*b*, a plurality of containers 2 are placed between the side walls 60 of the spacer in the desired arrangement. This can be done by pushing the containers 2 via the open front end of the accommodating jig 50, for example from a supporting surface, a transport container or a conveying belt.

As will be readily apparent to the person skilled in the art, the bottom 51 is not absolutely necessary for this purpose. Rather, the accommodating jig 50 may also be disposed on a flat surface (not shown), on which the containers are then pushed.

Figure 3C:
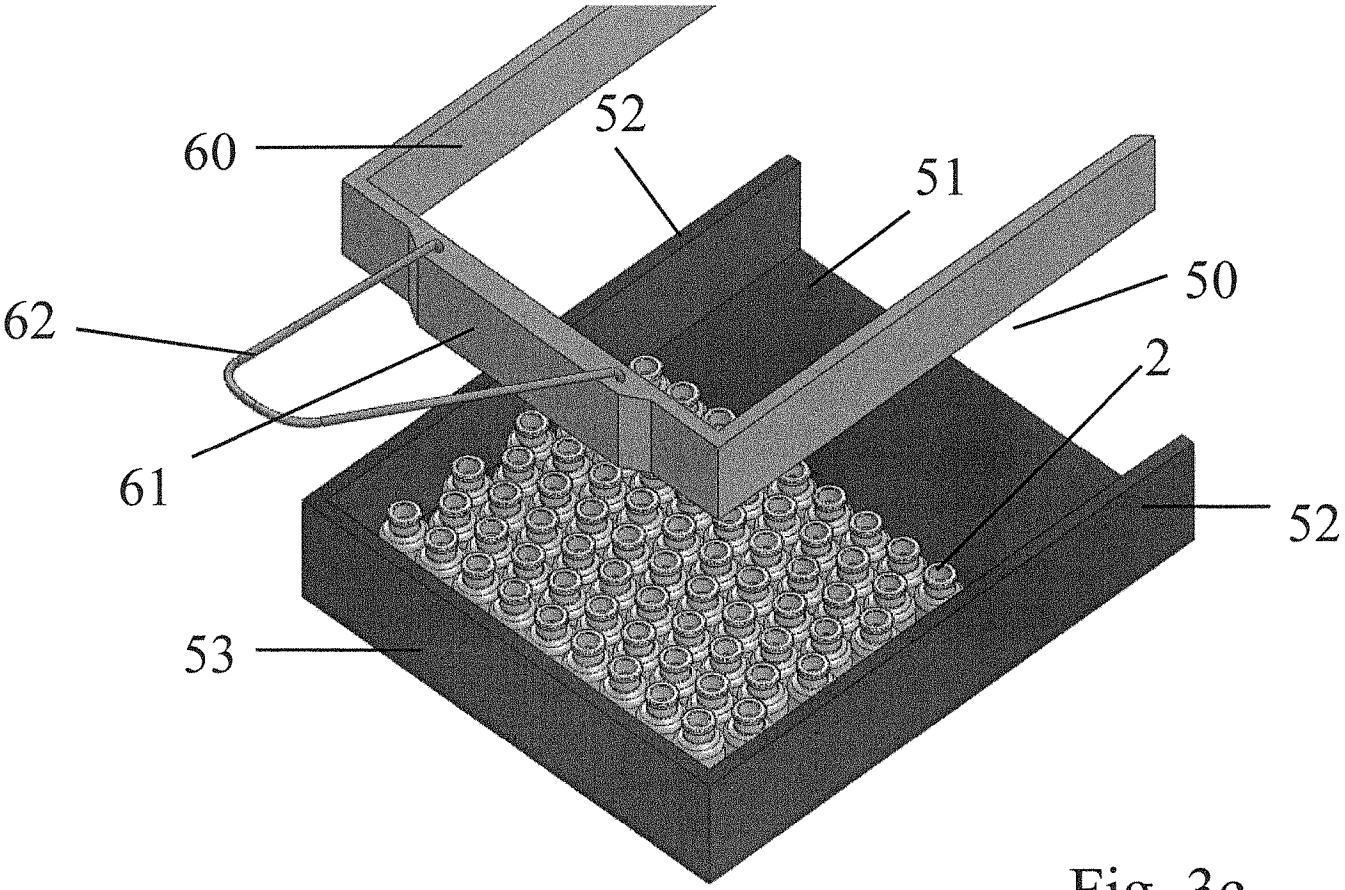

Subsequently, the U-shaped spacer is removed, as shown in FIG. 3*c*. In this state a gap remains between the side walls of the outermost container 2 of the rectangular arrangement of containers 2 and the side walls 52 and the rear wall 53 of the accommodating jig 50, wherein the width of the gap corresponds to the thickness of the side walls 60 and of the rear wall 61 of the spacer.

Figure 3D:
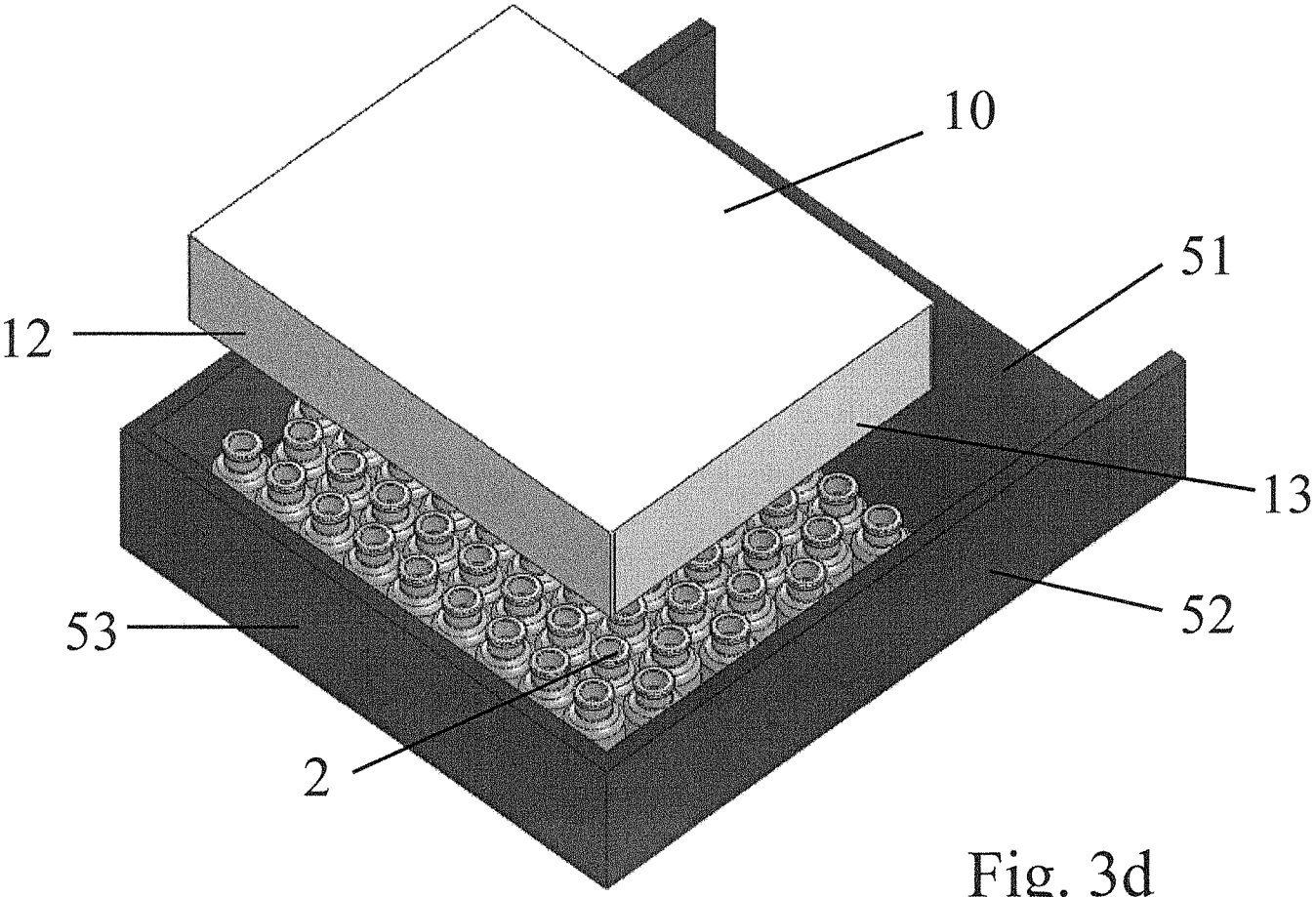

According to FIG. 3*d*, subsequently a box-shaped upper part 10 with a correspondingly rectangular base is placed onto the upper ends of the containers 2. Here, the wall thickness of the side walls of the upper part 10 should be smaller or equal to the thickness of the side walls 60 and of the rear wall 61 of the spacer.

Figure 3E:
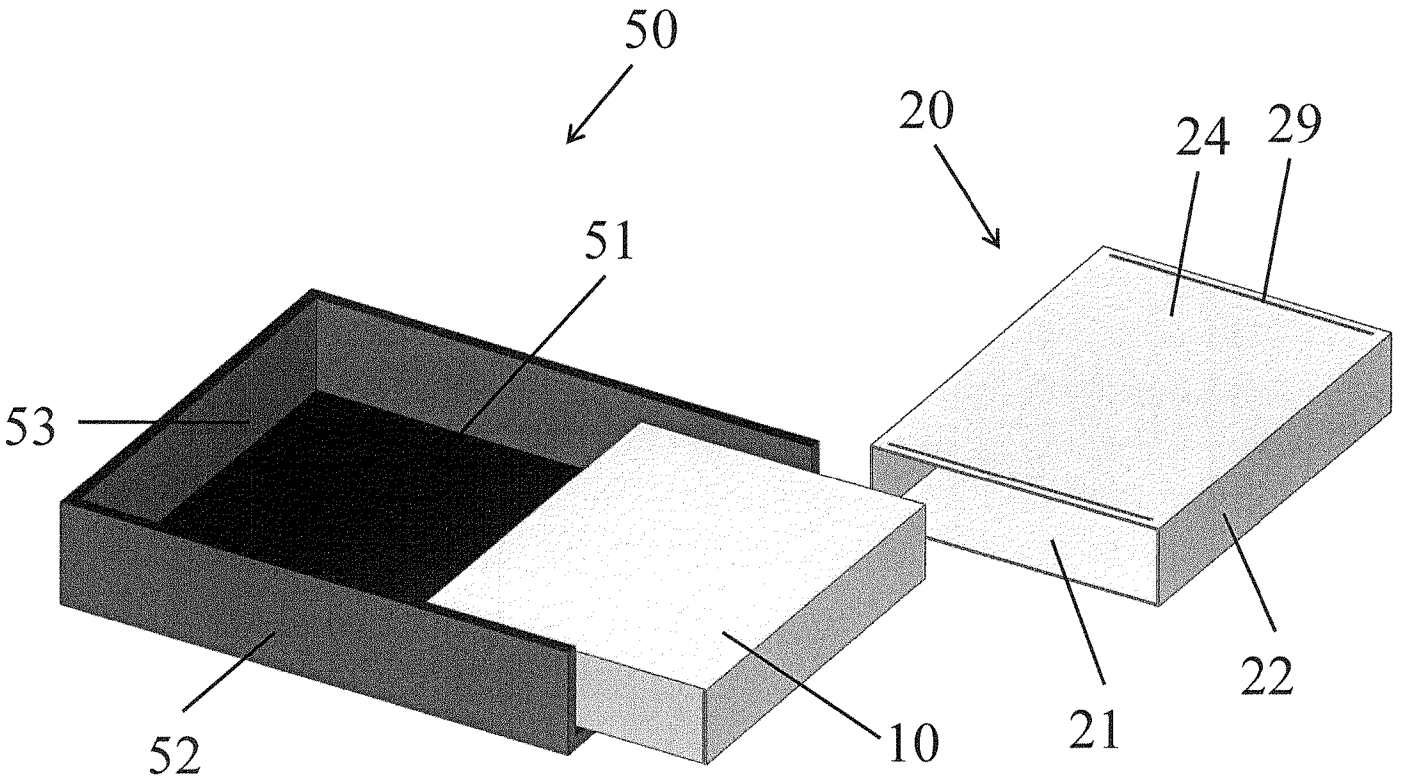
Figure 3F:
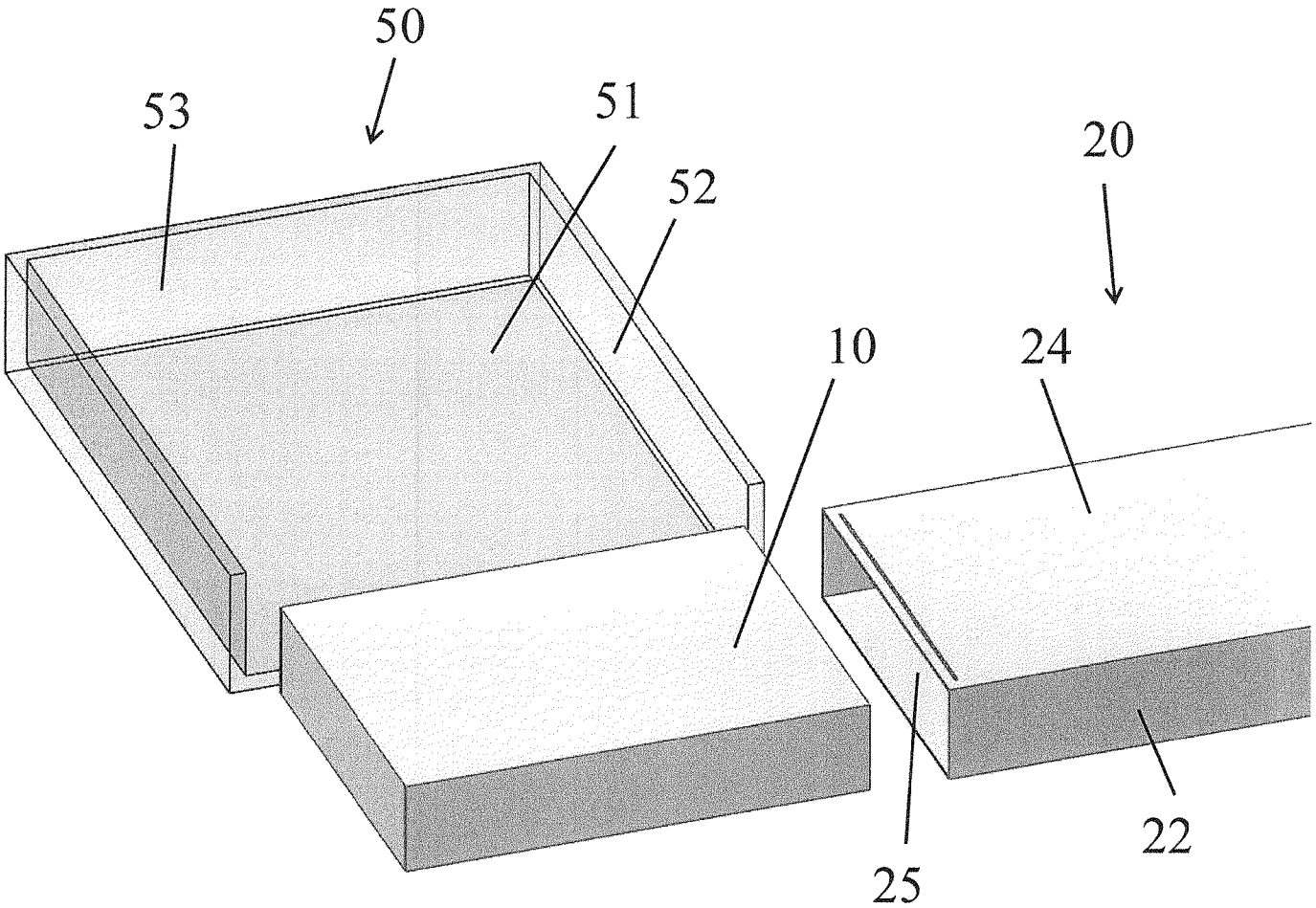
Figure 3G:
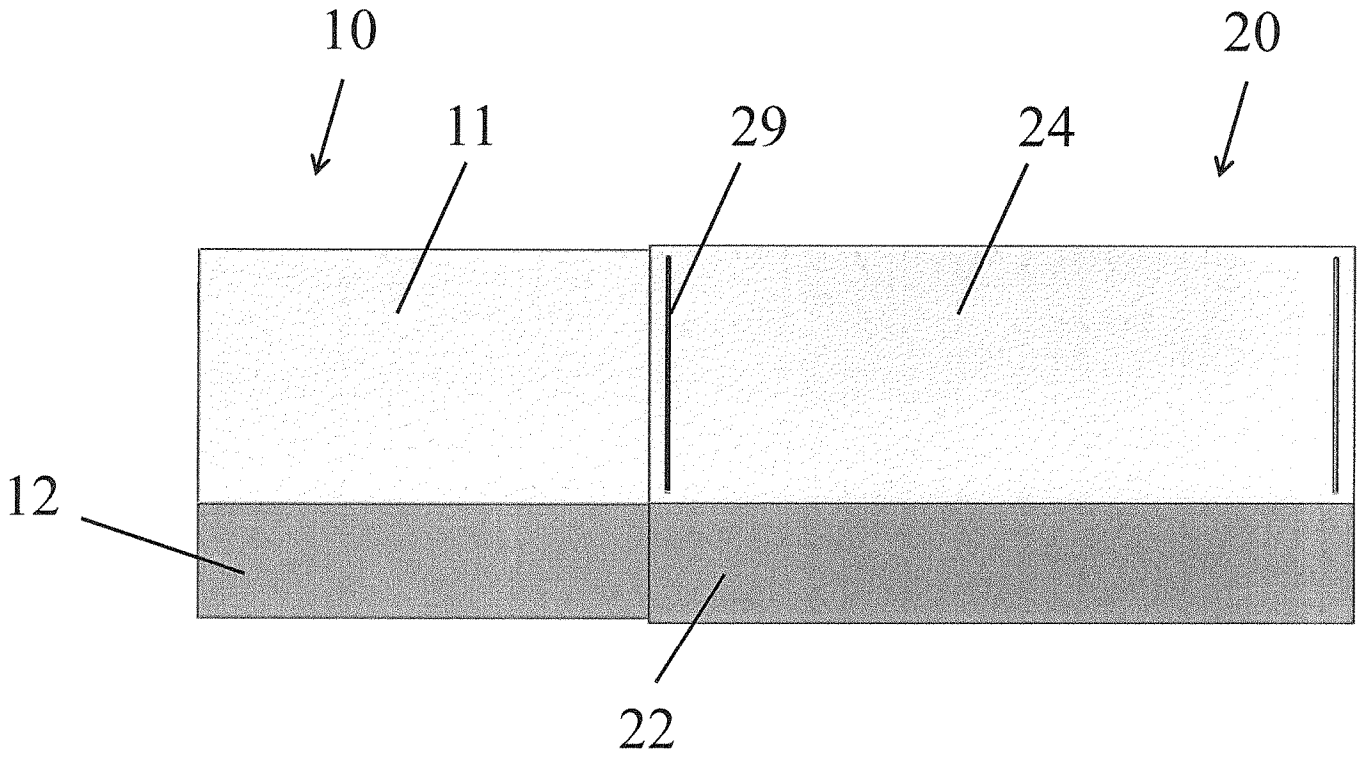
Figure 3H:
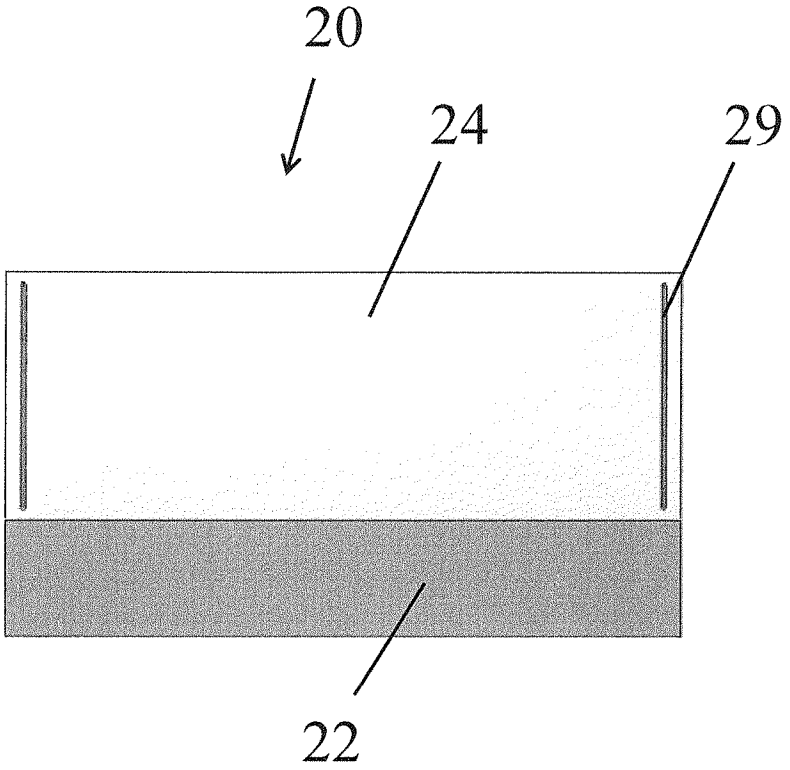
Figure 4A:
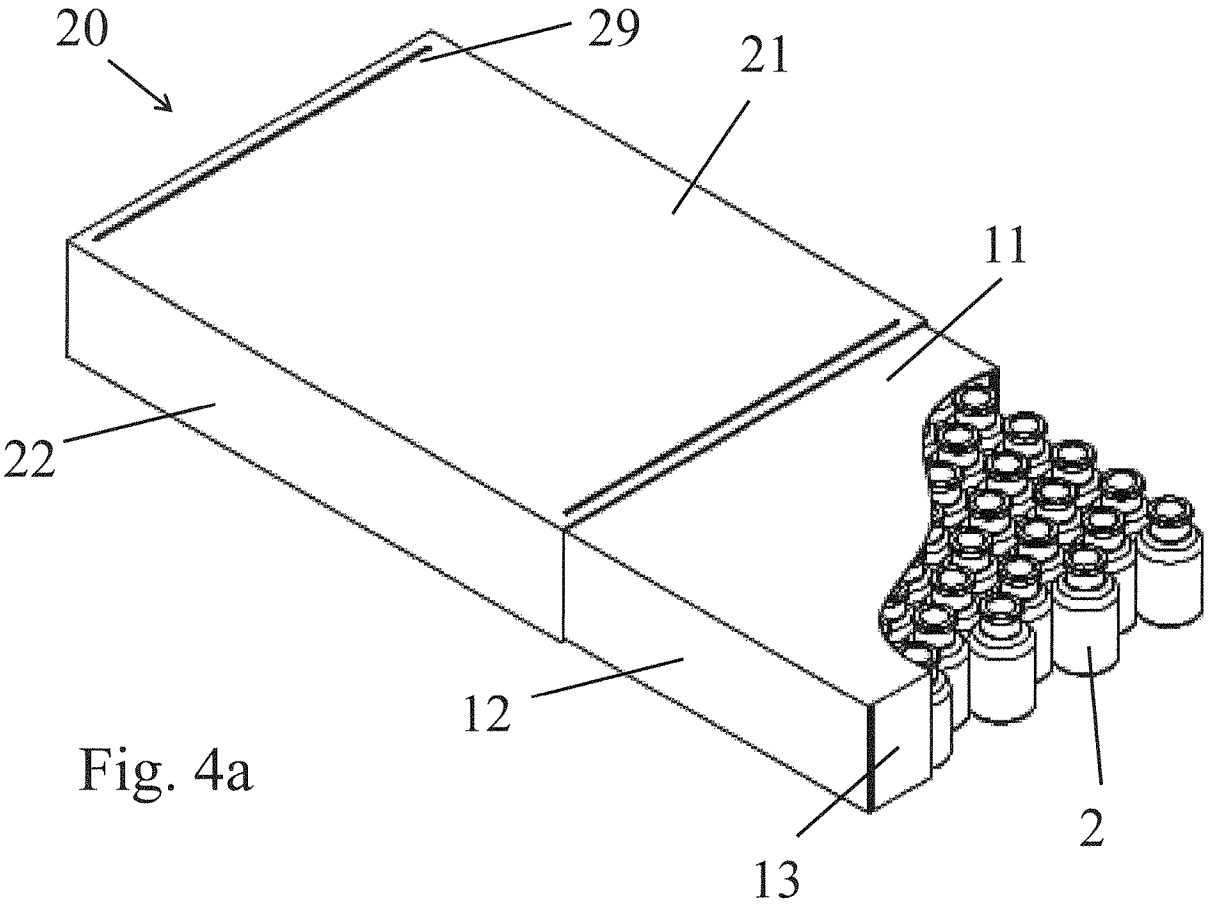
Figure 4B:
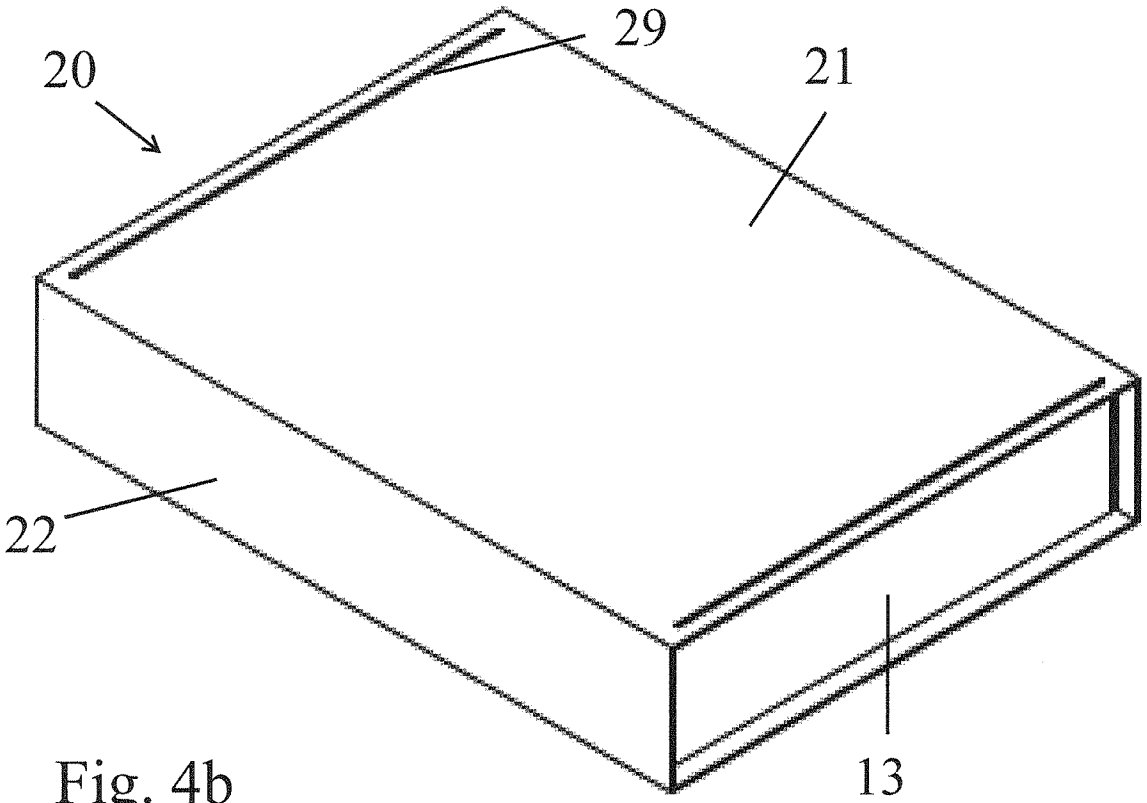
Figures 4C, 4D:
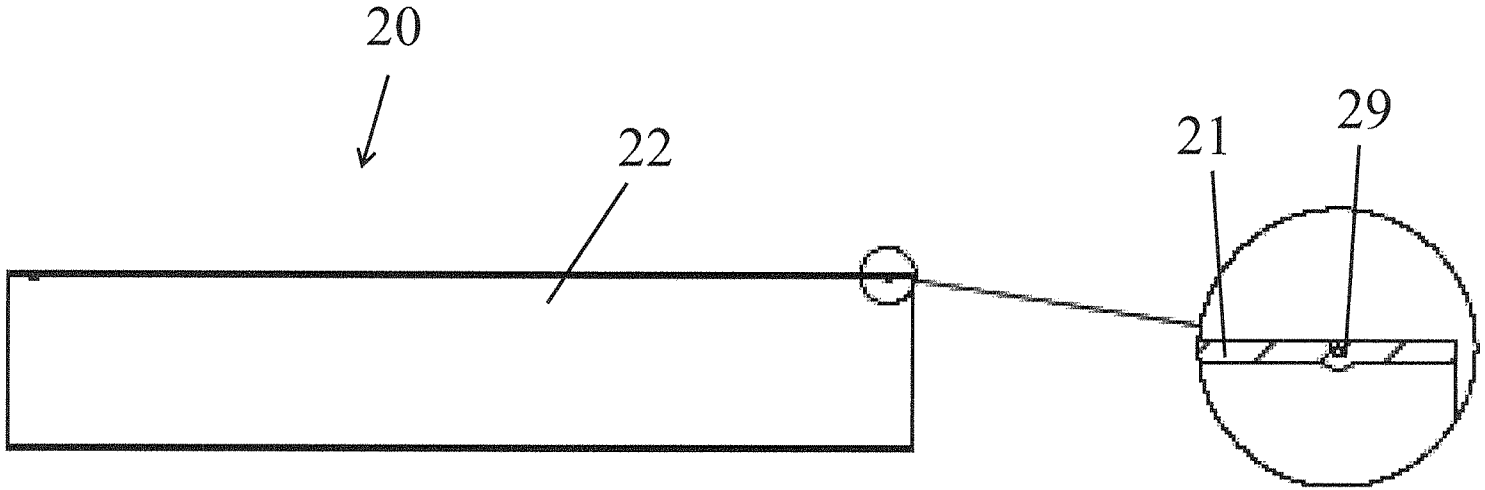

As shown in FIG. 3*e* and FIG. 3*f*, the containers are pushed out of the accommodating jig 50 by means of the upper part 10, namely in the region of an insertion opening of a lower part 20 that—contrary to the aforementioned embodiments—is not formed open at the upper end, but further comprises an upper cover 24. FIG. 3*f* shows a state in which the upper part 20 is pushed completely out of the accommodating jig 50. Subsequently, the upper part 10 is pushed into the lower part 20 via the insertion opening (see side view of FIG. 3*g*), until the packaging structure of FIG. 3*h* is formed.

In this procedure, it is advantageous if the lower ends or bottoms of the containers are always pushed on a flat support surface that has no elevations. This can be accomplished either by accommodation of the accommodating jig 50 (see FIG. 3*a*) and of the lower part 20 in a recess 20 having a depth which is dimensioned such that the upper side of the bottom 51 of the accommodating jig 50 (see FIG. 3*a*) and of the lower part 20 is flush with adjacent surface portions. Alternatively, this can be accomplished by supporting the accommodating jig 50 (see FIG. 3*a*) and the lower part 20 on a supporting surface, wherein those regions of the supporting surface, which are not located below the accommodating jig 50 and the lower part 20, are formed slightly elevated, namely elevated by the thickness of the bottom of the accommodating jig 50 and of the lower part 20, so that the containers can be displaced without height offset. A smooth displacement of all containers can also be accomplished by the formation of ramp-like inclined transition zones at the front edge of the accommodating jig 50 and of the bottom 21 of the lower part 20. Alternatively, the accommodating jig 50 may also be formed without a bottom.

In this embodiment, the containers are accommodated in the upper part 10 preferably without play and with a direct wall-to-wall contact. In particular, the containers may also be held clamped in the upper part 10. In the latter case, the clamping of the containers in the upper part 10 particularly may be such that the upper part together with the containers accommodated therein in a clamped state is raised and inserted into a lower part, rather that the upper part 10 displaces the containers. Basically, the containers may also be accommodated in the packaging structure loosely and with lateral play.

As will readily be apparent to the person skilled in the art, also the front end of the accommodating jig 50 (see FIG. 3*a*) may be closed by an upright side wall, so that there will be no need to push the containers into the accommodating jig 50 but instead the need that the containers are to inserted from above, which is more complex though, but may be implemented for example by means of gripper arms or the like.

FIGS. 4*a*-4*d* show further details of the packaging structure according to FIGS. 3*a*-3*h*. According to FIG. 4*a*, a sealing member 29 is provided along the front edge of the lower part 20, which may be accomplished, for example, by an elastic insert made of a rubber or plastic material which may also be injected into the bottom 21 of the lower part 20 using 2K technology, or by forming an elastic sealing member directly in the bottom 21 of the lower part 20. According to FIGS. 4*c* and 4*d*, the sealing member is implemented by a bead 29, which protrudes inwardly from the bottom 21. Thus an elastic resistance needs to be overcome when pushing the upper part 10 into the lower part 20.

Figure 5A:
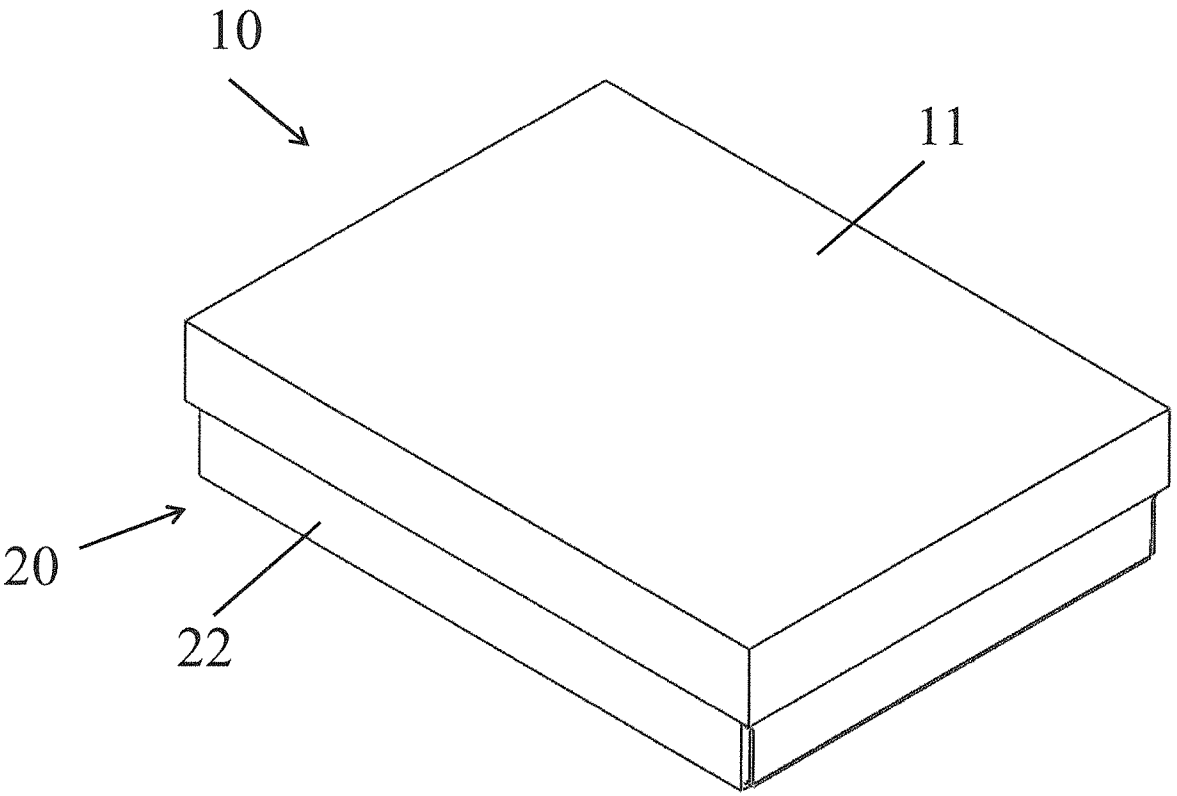
Figure 5B:
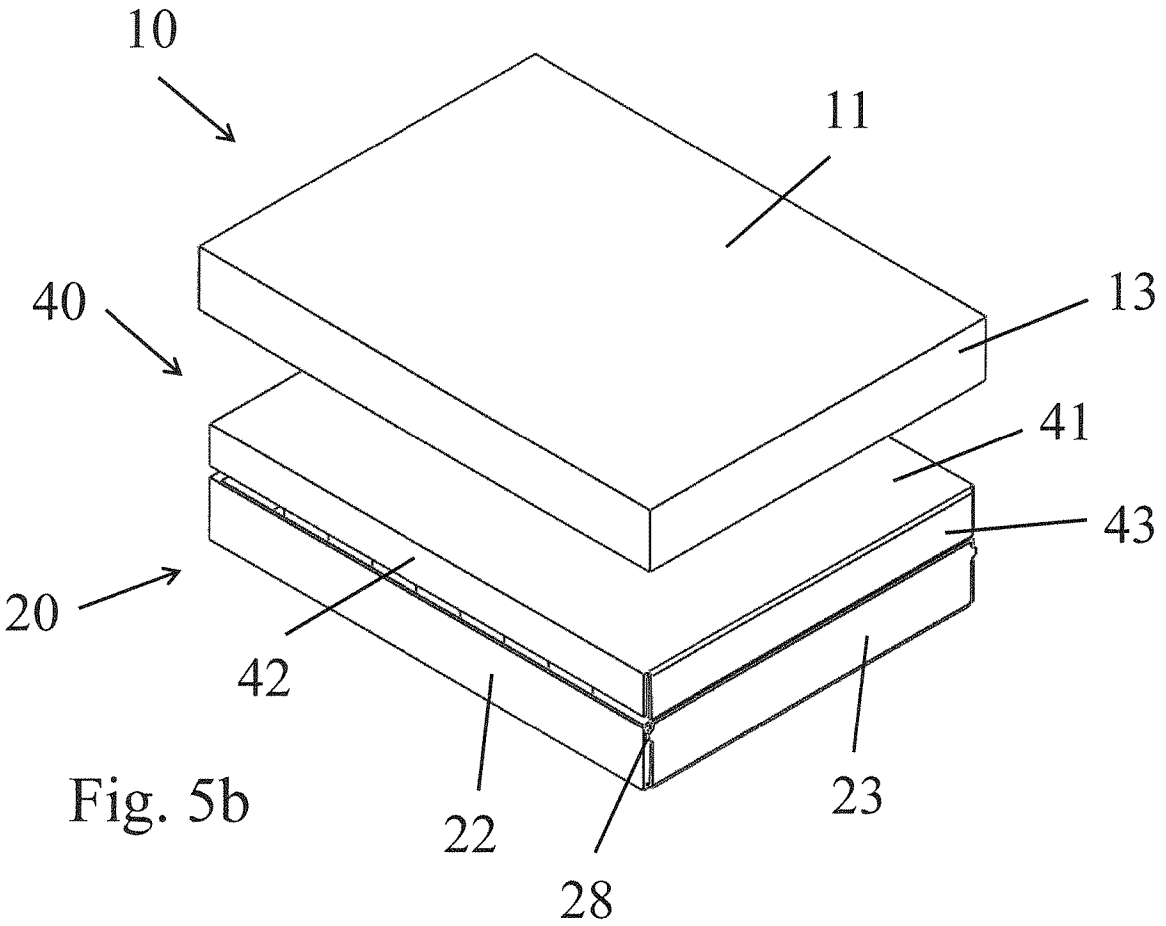
Figure 5C:
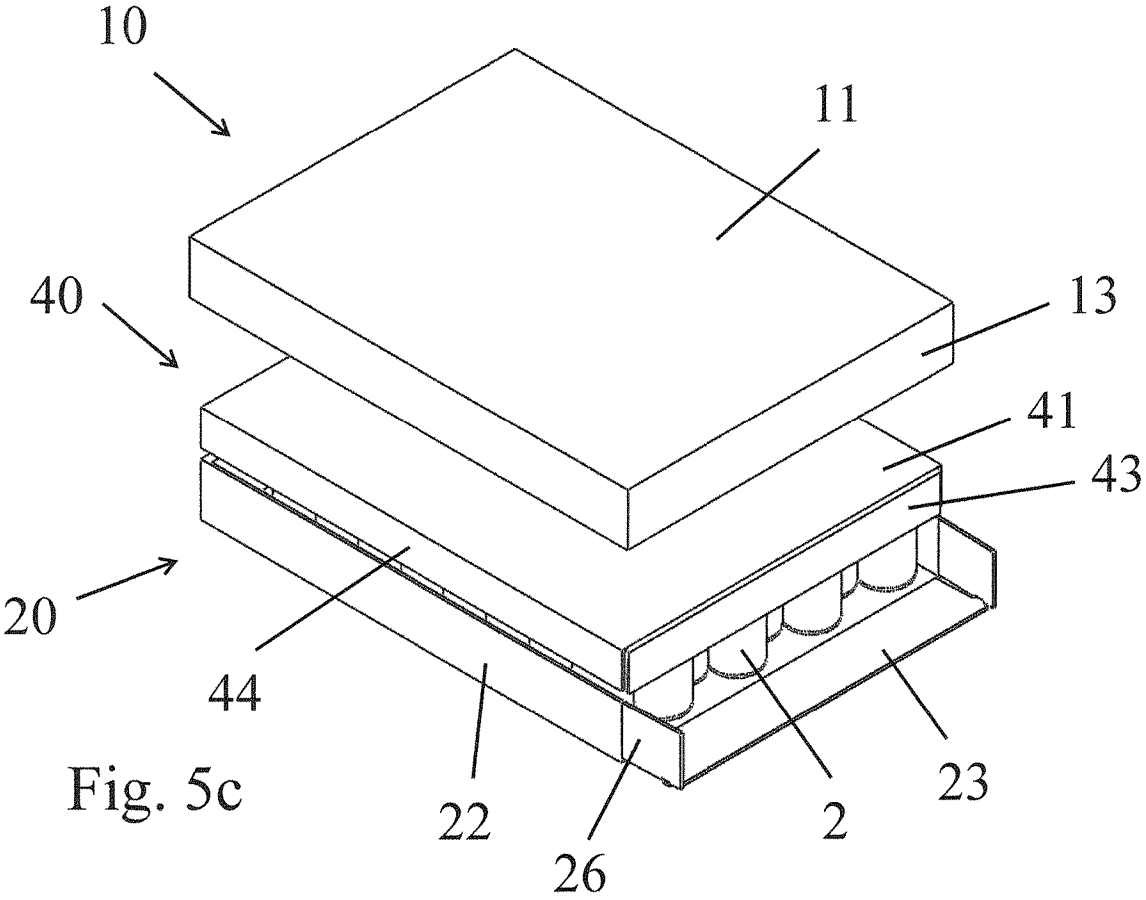

FIGS. 5*a*-5*f* show details of the procedure for opening of a packaging structure according to a further embodiment of the present invention. As shown in FIG. 5*b*, a box-shaped intermediate part 40 is placed onto the upper ends of the containers, which comprises a flat bottom 41 and side walls 42 projecting perpendicularly therefrom. This intermediate part 40 may rest permanently on the upper ends of the containers to prevent intrusion of particles into the open ends of containers even when the upper part 10 has been removed, as shown in FIG. 5*c*. Here, the side walls 42 prevent an inadvertent lateral slipping off of the intermediate part 40.

Figure 5D:
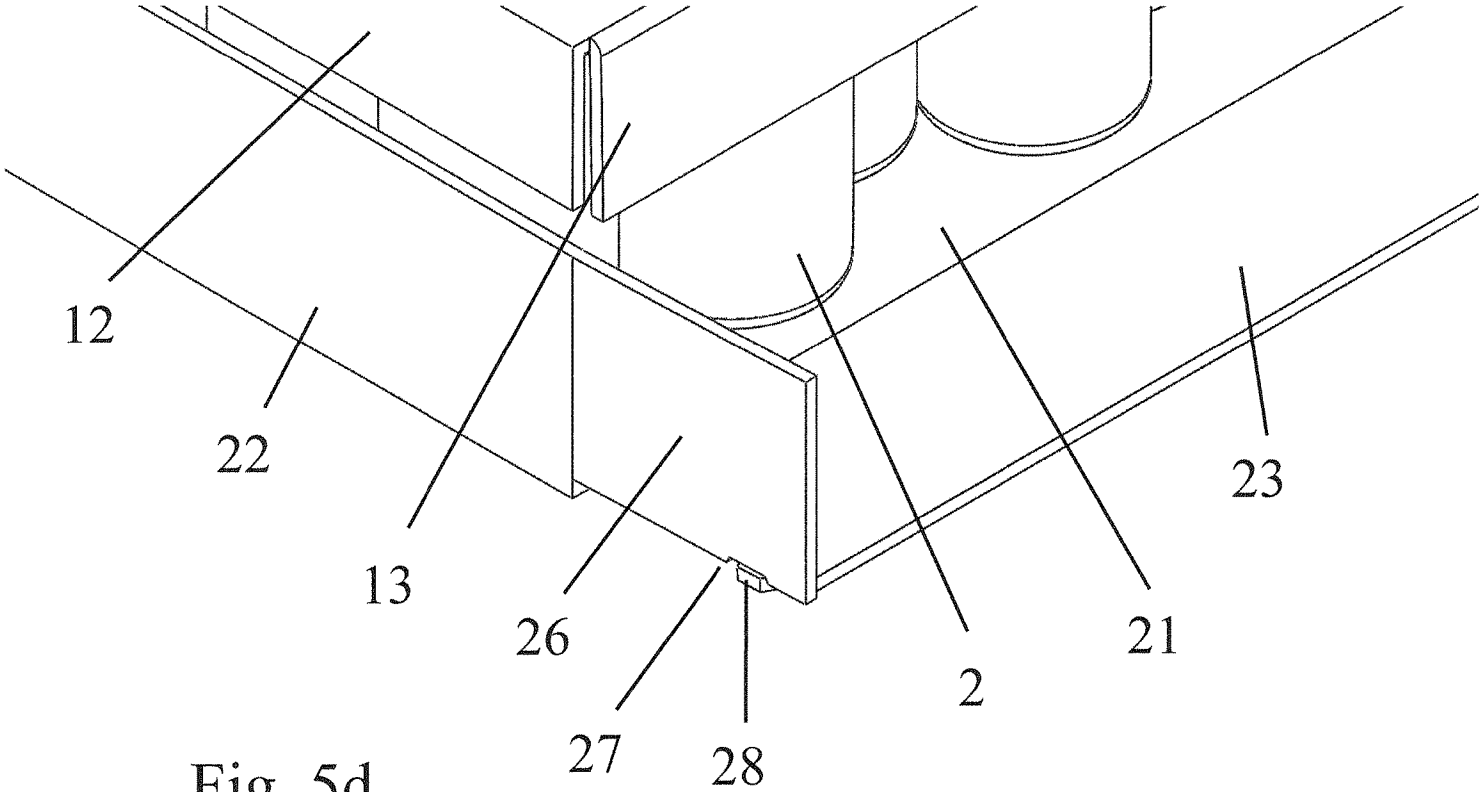
Figure 5E:
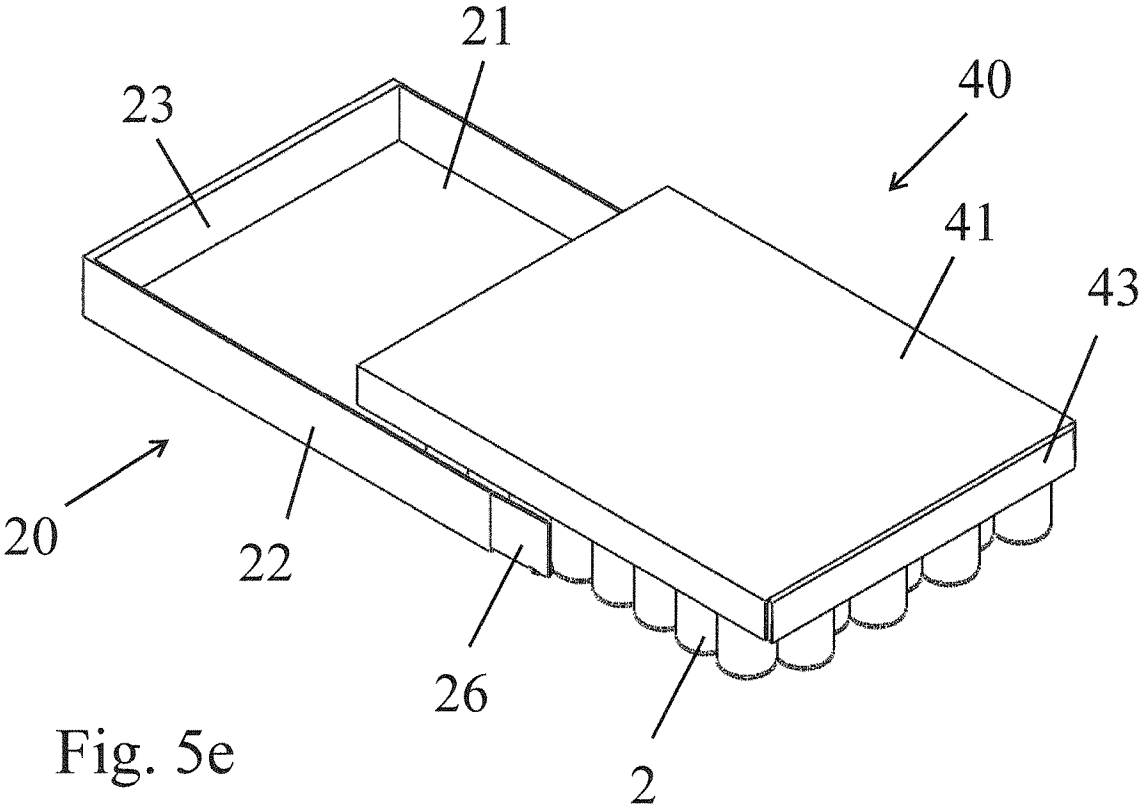
Figure 5F:
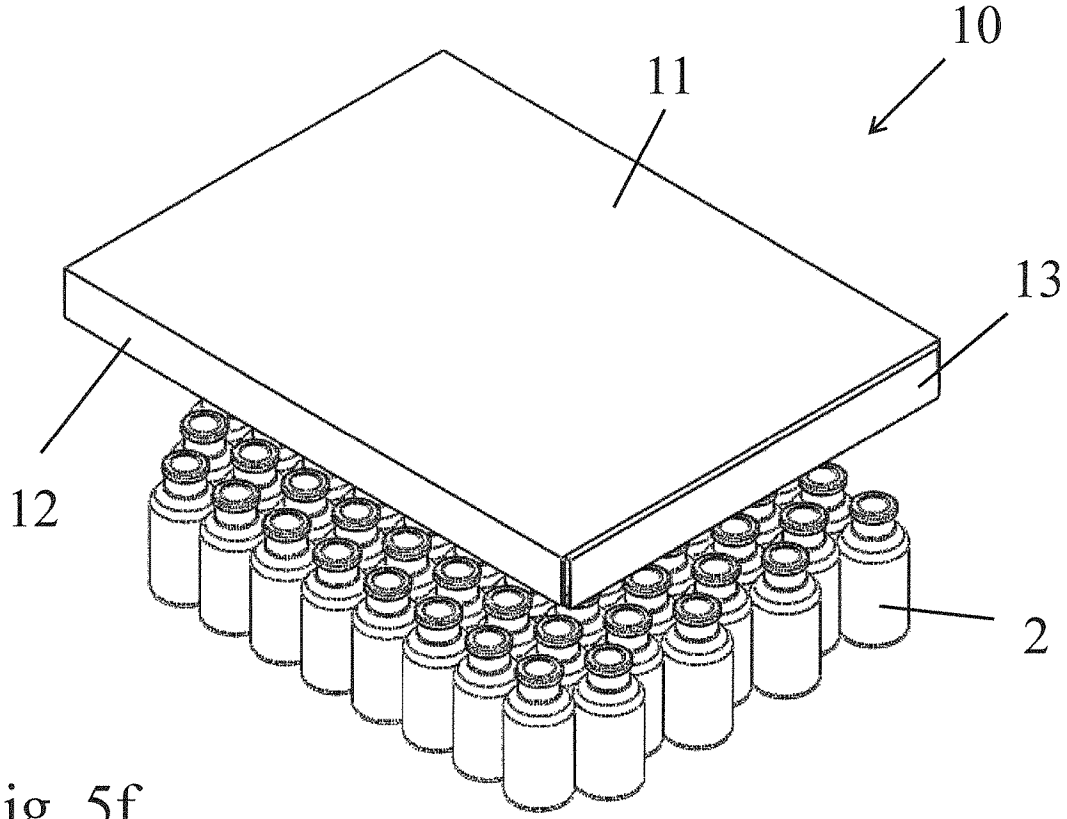

According to FIG. 5*c*, the front side wall 23 of the lower part 20 is folded down to allow a pushing out of the containers 2 by displacement of the intermediate part 40. In order to prevent a disturbing folding back of the front side wall 23, the side lugs 26 of the lower part 20 hold the front side wall 23 pushed down, namely in a position in which the front side wall 23 is flush with the plane of the bottom 21 of the lower part 20. As shown in FIG. 5*d*, for this purpose rectangular recesses 27 are formed in the side lugs 26, into which rectangular protrusions 28 engage, which are formed correspondingly on the side edge of the front wall 23. In this position, the intermediate part 40 together with the containers 2 accommodated therein can be pushed out of the lower part 20, as shown in FIG. 5*e*. Subsequently, by lifting the upper part 10 access to the containers 2 is made possible for the treatment or further processing.

As shown in FIGS. 6*a*-6*c*, rather than by means of the intermediate part 40 shown in FIGS. 5*a*-5*e* all the containers 2 can also be pushed out of the lower part 20 by means of a pusher 37. The strip-shaped pusher 37 shown in FIG. 6*a* extends along the rear wall 23 of the lower part, wherein the front ends of a bracket 39 acting as a displacement device are inserted into blind holes 38 in the pusher 37. This strip-shaped pusher 37 may be in particular an elastic insert, which biases and permanently clamps the containers 2 accommodated in the box-shaped lower part 20 due to its elasticity, as set forth above. In order to accomplish that the front side wall 23 is not rocketing upward when the containers 2 are pushed out of the lower part 20 according to FIG. 6*b*, the front side wall 23 is pushed or pressed down by the side lugs 26, as described above with reference to FIG.

5*d*. Finally, the state of FIG. 6*c* is reached, in which all containers 2 are completely pushed out of the box-shaped lower part 20.

Alternatively, the containers 2 may also be pushed out of the box-shaped lower part 20 in rows or individually by means of a strip-shaped plate. Such a strip-shaped plate may in particular also be a partitioning strip, which prevents a collision of directly adjacent containers in the packaging structure, as set forth above. Such a partitioning strip may also consist of an elastic material, as set forth above.

Figure 7A:
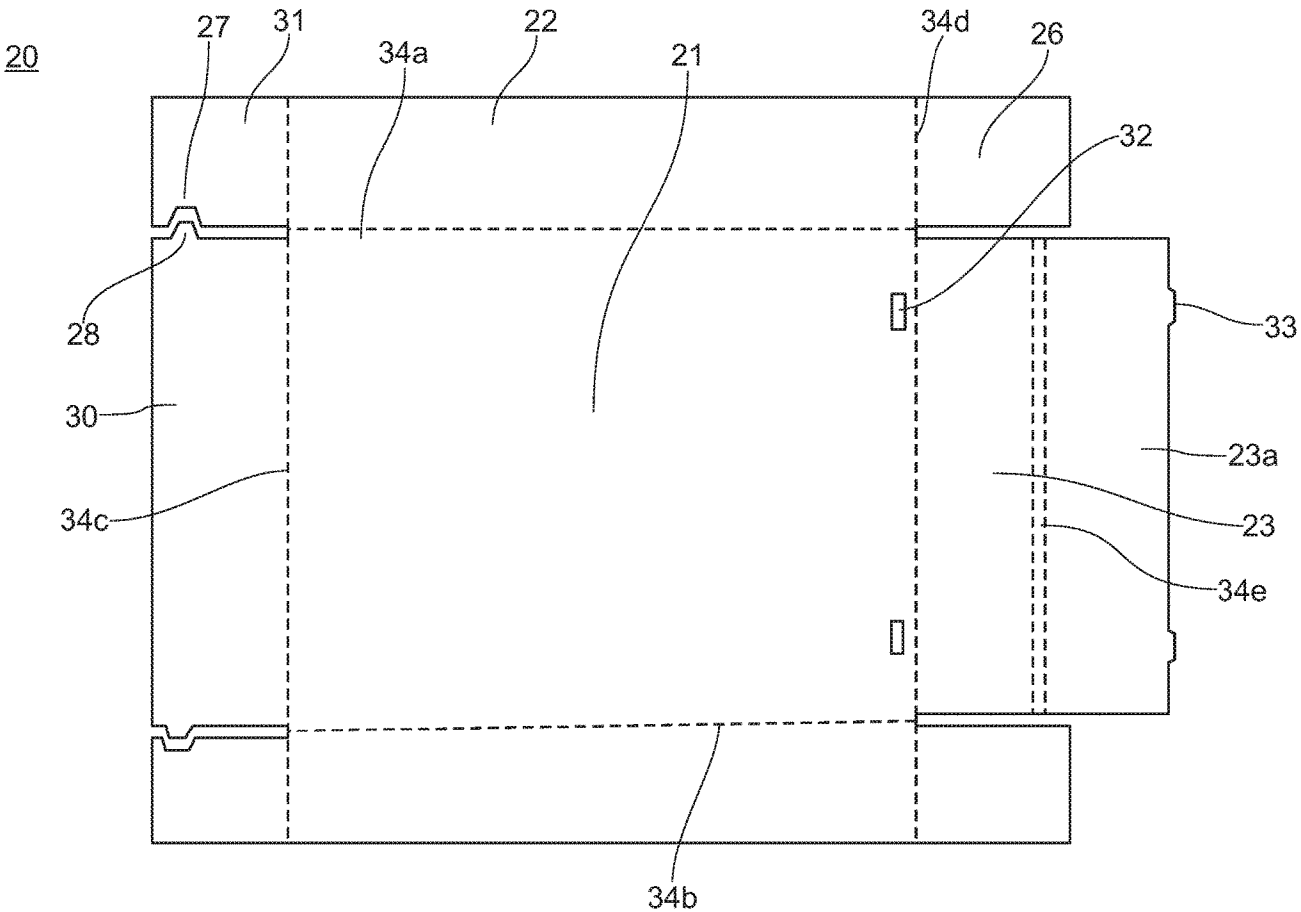

As shown in FIG. 7*a*, a box-shaped lower part 20, as described above, may also be punched out from a material sheet and produced by suitable folding. In FIG. 7*a*, the corresponding folding lines are designated by the reference numerals 34*a*-34*e*. By punching out recesses 27 on the rear side lugs 31 and protrusions 28 on the rear wall 30, it is possible to permanently press down the rear wall 30, as described above with reference to FIG. 5*d*. In this embodiment, the front side wall 23 is formed doubled, namely by folding along the folding line 34*e* and folding the doubled side wall 23*a* in the direction of the side wall 23. By inserting the protrusions 33 formed at the upper edge of the doubled side wall 23*a* into correspondingly formed recesses 32 on the bottom 21 of the lower part 20, the front side wall 23 optionally can be folded up (for retaining the containers) or folded down (for pushing the containers in or out). In the folded-up position the side lugs 26 are inserted into the gap between the front side walls 23, 23*a*. When folding up the front side wall and the rear wall of the lower part, these may thereby be stretched in order to implement the above-described permanent clamping of the containers in the lower part.

Figure 7B:
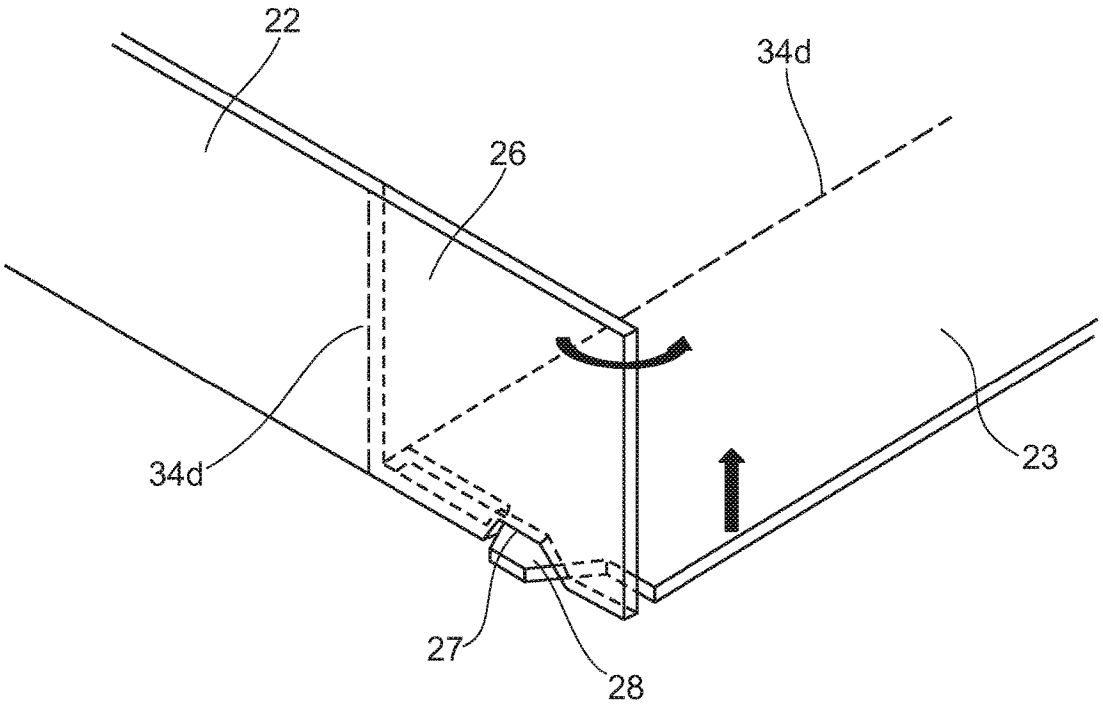
Figure 7D:
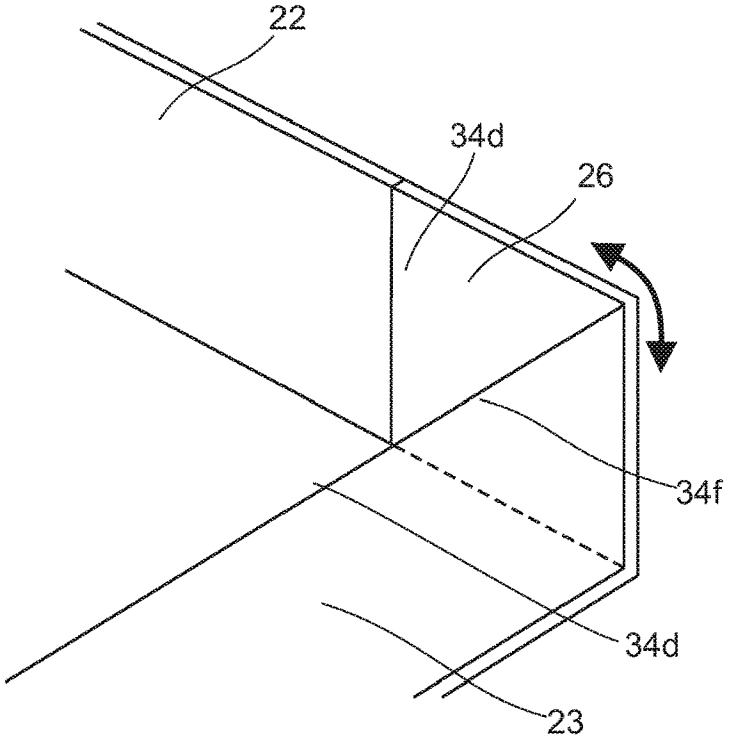
Figure 7C:
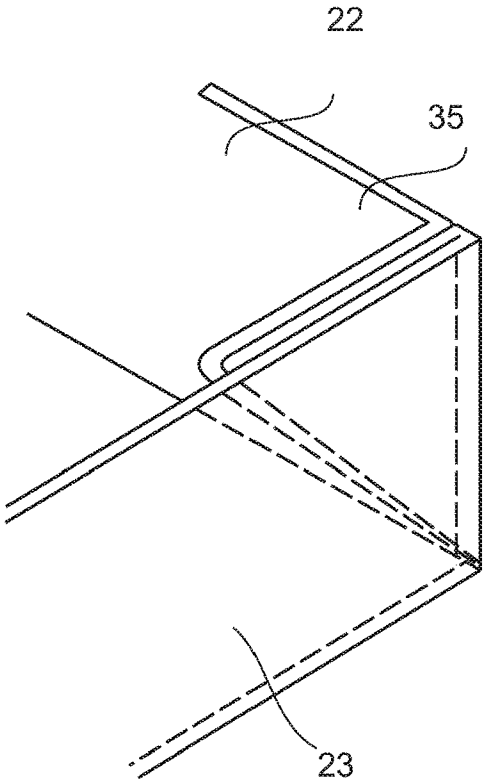

FIG. 7*b* explains again the permanent pressing down of the front side wall by means of interlocking protrusions 28 and recesses, wherein the displacement required for taking and releasing this position are indicated by the displacement arrows. FIGS. 7*c* and 7*d* show an alternative for the permanent pressing down of the front side wall, wherein a diagonal folding line 34*f* extends in the front side plate 26, wherein the front side wall 23 and the side lugs 26 are connected to each other (see FIG. 7*d*) and wherein the position according to FIG. 7*c* with the front side wall 23 folded upward can be accomplished by pressing along the folding line 34*f* and pivoting the side lugs 26 about the folding line 34*d* and wherein the open state according to the FIG. 7*d* can be accomplished again in the reverse sequence.

FIG. 8*a* shows a three-part packaging structure as described above, having a lower part 20 in which the containers are accommodated, an intermediate part 40 placed on the upper ends of the containers and an upper part 10 placed on the intermediate part 40.

FIG. 8*b* shows a further embodiment, wherein the containers 2 are initially positioned on the bottom 21 of the lower part 20 in a state in which the front and rear side wall 23 is not yet folded upward. In this state, the containers 2 can be pushed inward, in particular via the open front and rear ends. Then, the upper part 10 is placed on the upper ends of the containers 2. According to FIG. 8*b*, recesses are formed in the bottom 11 of the upper part 10, into which the side lugs 26*a* are inserted when folding up the front and rear side walls 23 and when further folding the doubled side walls 23*b* on which the side lugs 26*a* are provided. In this way the upper part 10 and the lower part 20 are connected by means of a plug connection.

FIG. 8*c* shows a further embodiment, wherein the two longer side walls 22 are formed doubled by double-folding in a corresponding manner, but wherein there are not provided any front and rear side walls, because it is sufficient that the containers 2 are retained in the packaging structure by means of the side walls 12, 13 of the upper part 10. After folding twice the side walls 22, the side lugs 26, which are formed at the front ends thereof, are inserted into the recesses 14 in the bottom 11 of the upper part 10 in the manner described above with reference to FIG. 8*b* for connecting the upper part 10 and lower part 20 directly to each other.

FIGS. 9*a* and 9*b* show a packaging structure 1 according to a further embodiment, wherein the side walls 22 of the lower part 20 are provided with apertures 22*a* and wherein the bottom 11 of the upper part 10 is provided with a grid structure 11*a* formed by a plurality of intersecting webs with through holes or perforations formed therebetween. These through holes or perforations are sealed by a gas-permeable plastic foil, in particular by a web of synthetic fibers such as polypropylene fibers (PP) or by a Tyvek® protective film. This gas-permeable plastic foil may also be added subsequently, e.g. by bonding on the edges of the through holes, and enables a sterile and aseptic packaging of the containers within the packaging structure. Sterilization of the containers may also be accomplished in the packaging structure by providing a gas flowing in from the outside via the plastic foil and via the box-shaped receptacle of the packaging structure into the interiors of the containers 2 for the sterilization of the containers. Finally, the packaging structure further may be sealed in a sleeve or placed in a sealable bag (see FIG. 2*d*) or be placed in a sterile transport and packaging container.

The aforementioned through holes or perforations may in principle be provided also in the bottom of the lower part, wherein the containers may slide easily over the bottom into the lower part and pushed out of it again if the grid of the aforementioned mesh structure 11*a* is appropriate.

FIGS. 10*a* to 10*d* show details of a packaging structure according to a further embodiment of the present invention. In this embodiment the upper part 10 is box-shaped, having a bottom 11 and side walls 12 and 13 projecting perpendicularly therefrom, wherein a flange 15 projects perpendicularly along the two longer side walls 12. This upper part 10 is formed preferably as a thermal molding member of a plastic material.

The lower part 20 is formed by folding of a plastic sheet having a bottom 21 and two lateral clamping webs 200 at each end of which a rectangular protrusion 201 is formed. The clamping webs 200 are connected to the bottom 21 via a film hinge and can thus be folded. In the corner regions of the rectangular bottom 21 mushroom-shaped protrusions 203 (or openings) are formed which engage with correspondingly shaped openings 202 (or mushroom-shaped protrusions) of the extension 201 after folding the lateral clamping webs 200. The lower part 20 is preferably formed as an injection molding member from a plastic material. In the area 209 of bottom 21 indicated by dotted lines (or also in the upper part 10) through holes may be formed as a grid structure of a plurality of intersecting webs, which can be sealed by means of a gas-permeable plastic foil, in particular by means of a mesh made of synthetic fibers, and by means of which the containers in the packaging structure can be sterilized by a gas flowing in, as described above.

Figure 10A:
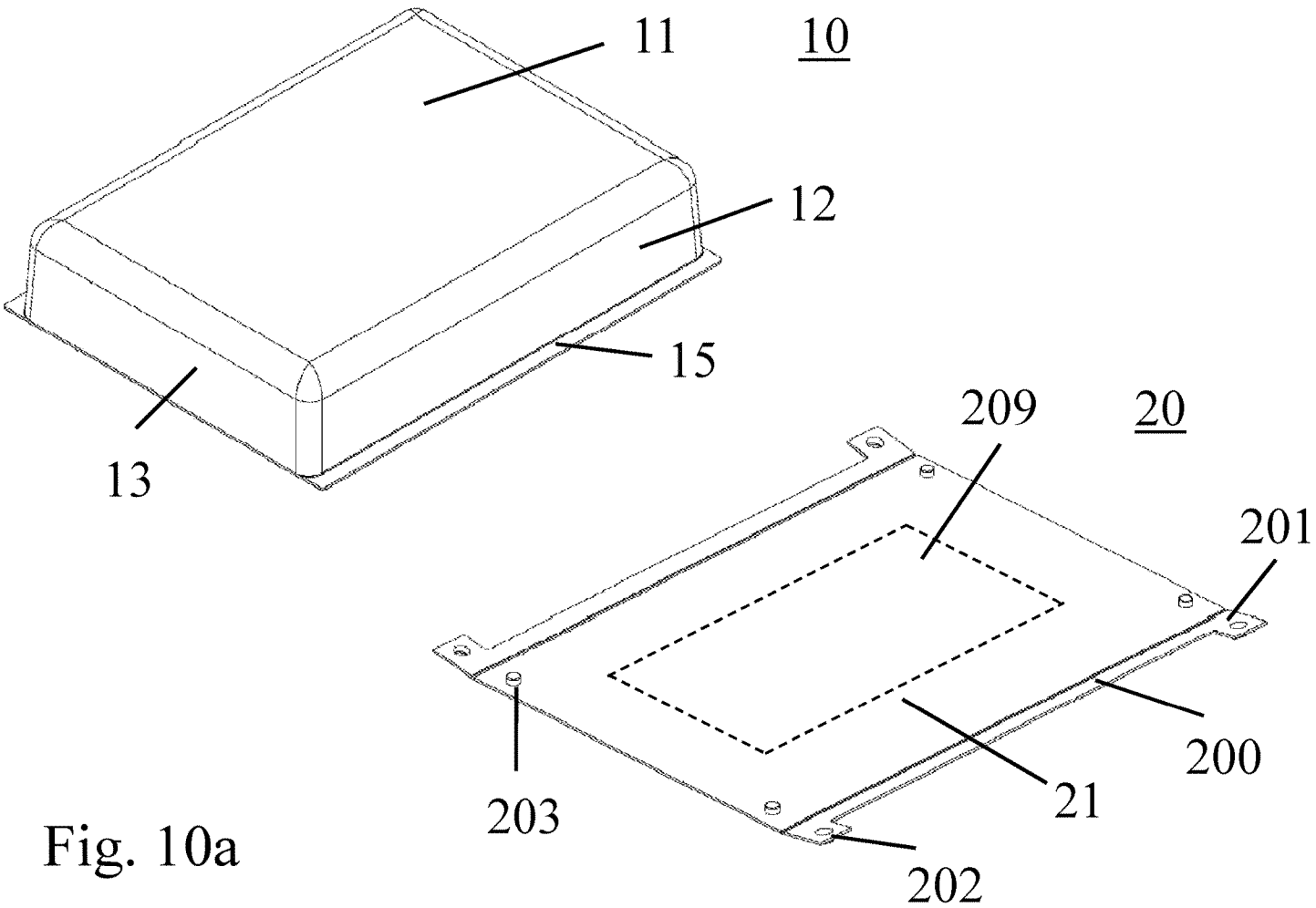
Figure 10B:
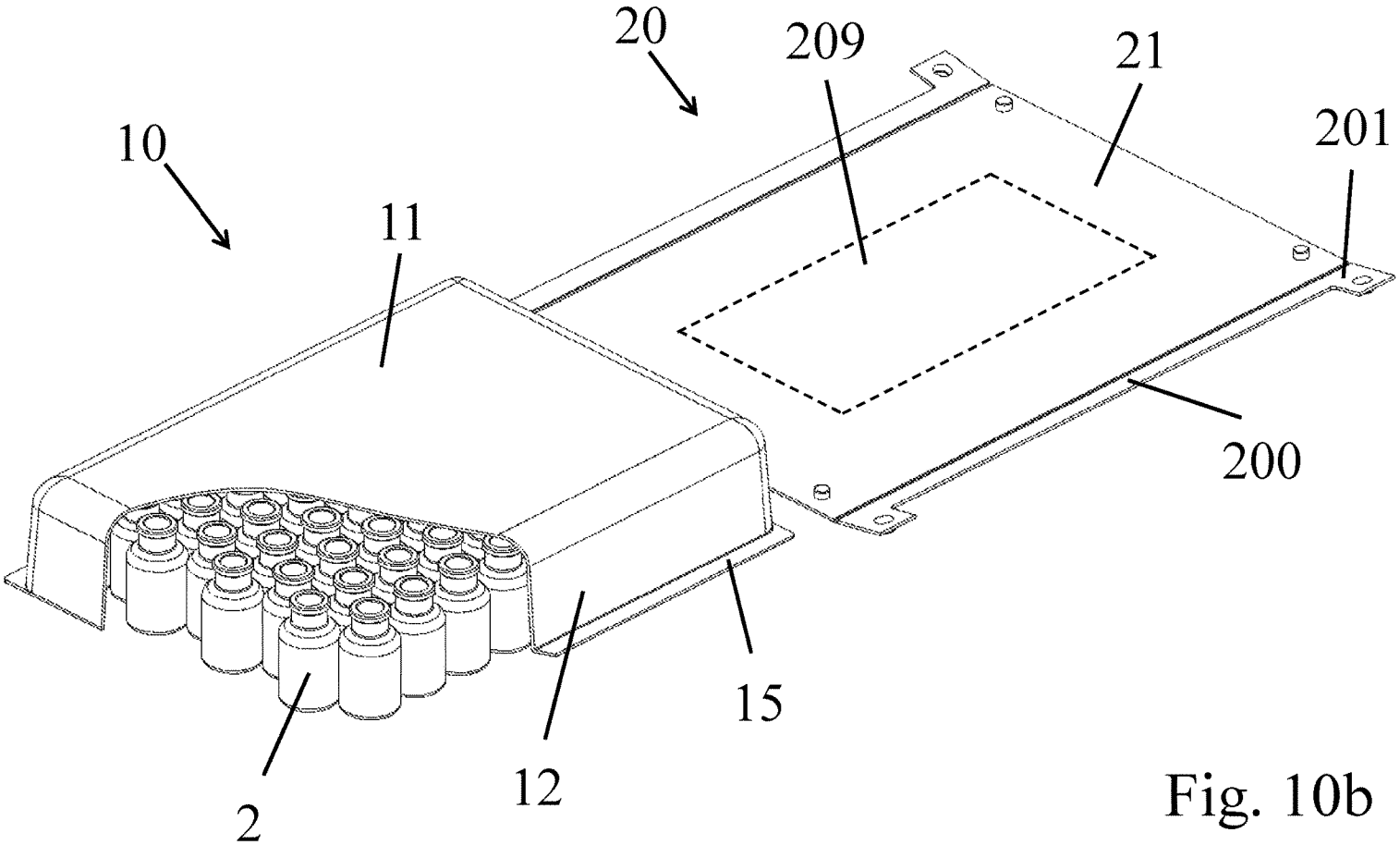

The packaging process begins according to FIG. 10*b* with insertion of the containers 2 into the box-shaped receptacle of the upper part 10, for example, by placing the containers 2 on a flat surface with a high packing density and placing the box-shaped upper part 10 on the containers 2, so that the arrangement of the containers 2 shown in FIG. 10*b* is automatically obtained. The upper part 10 together with the containers 2 accommodated therein is then pushed onto the bottom 21 of the lower part 20. The upper part 10 is then connected to the lower part 20, in particular by latching.

Figure 10C:
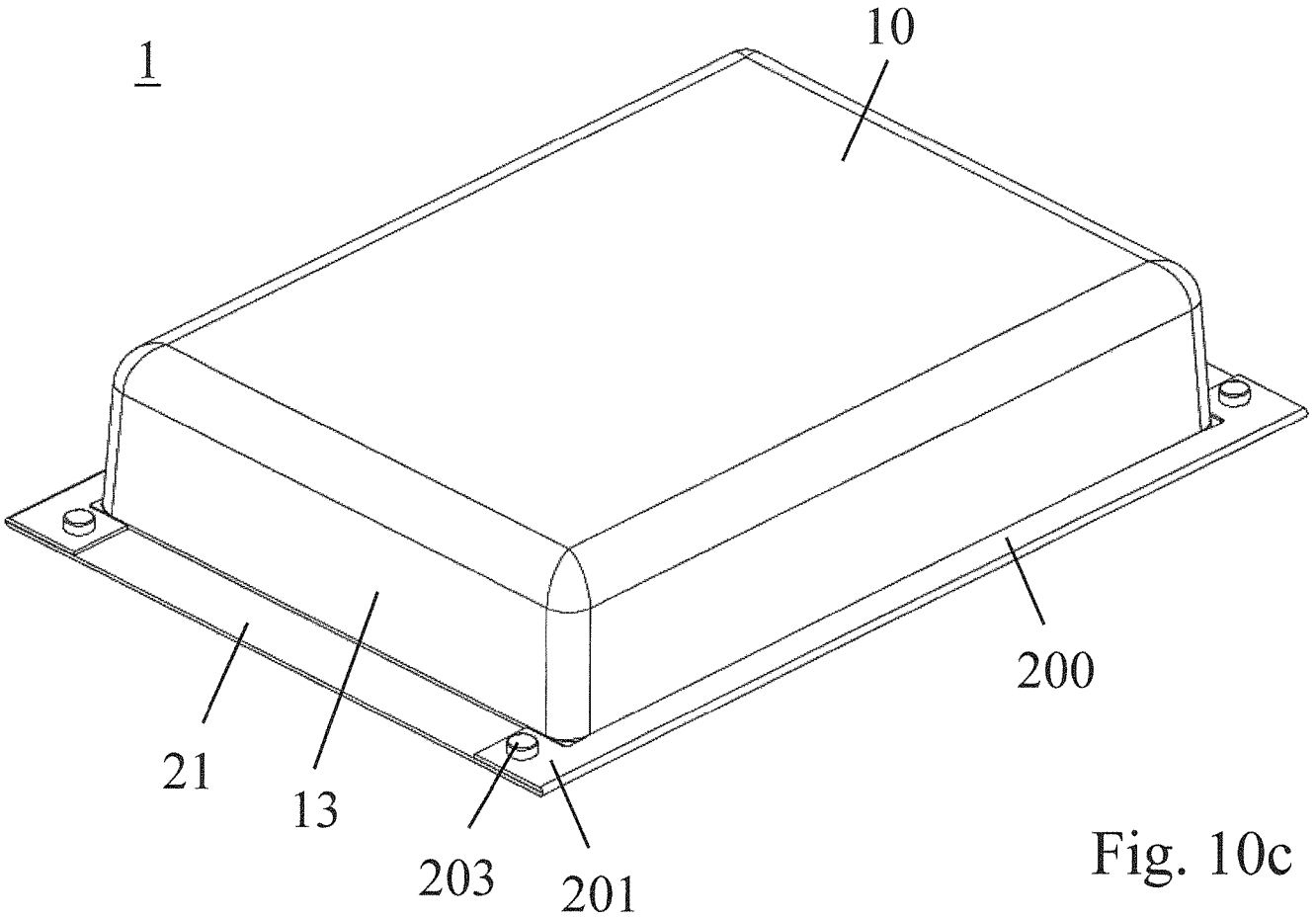

For this purpose, according to FIG. 10*c* the lateral clamping webs 200 of the lower part 20 can be folded and the protrusions 203 can be pressed into the openings 202 of the extensions 201. The folded extensions 201, on which the front and rear side wall 13 of the upper part rests, precisely define the position of the lower part 10 relative to the lower par 20. The fixing of this position is implemented by means of the clamping webs 201, which clamp the respective flange 15 (see FIG. 10*a*) of the upper part 10, and by latching of the protrusions 203 into the openings of the extensions 201.

Figure 10D:
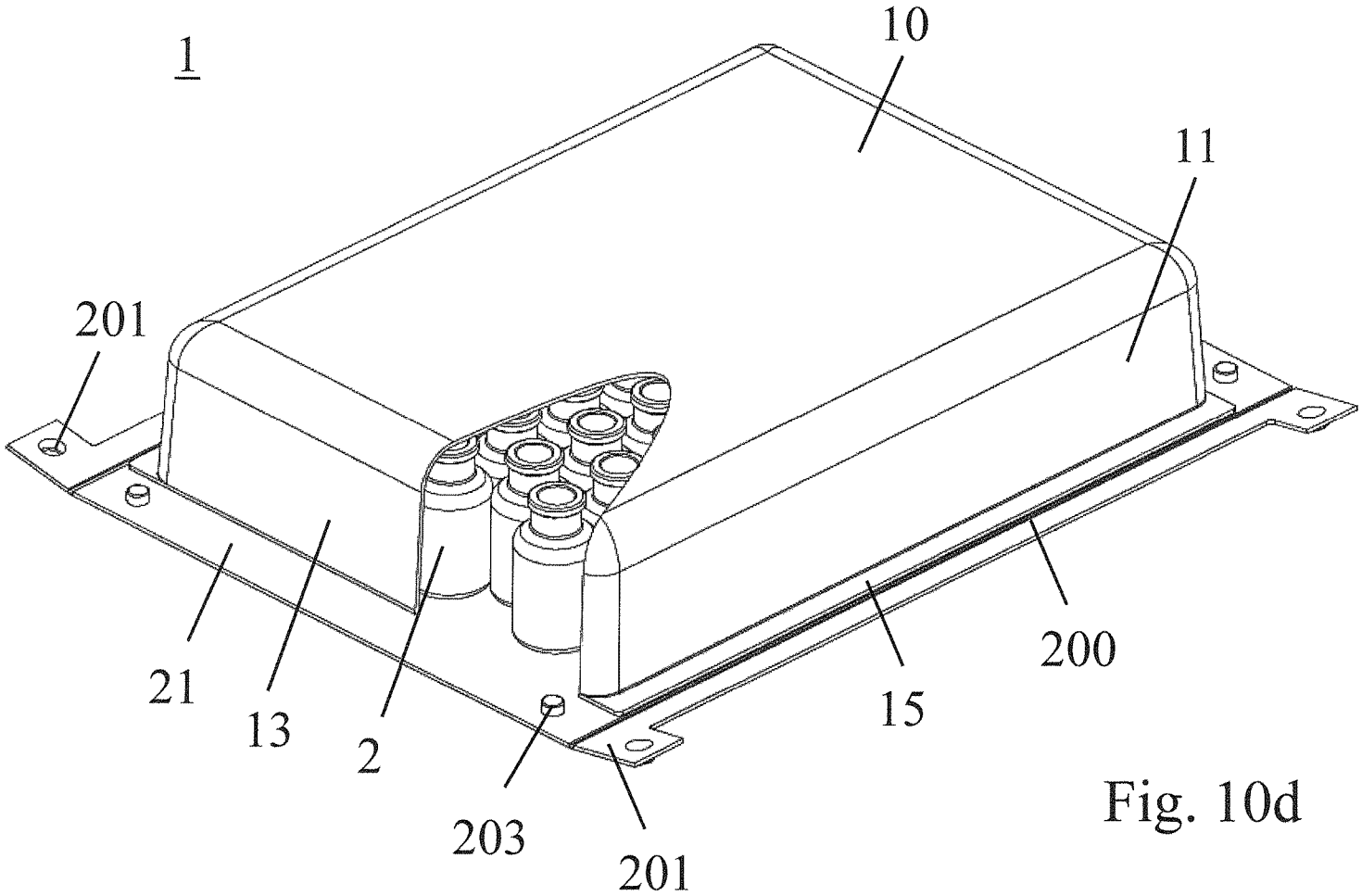

Opening of this packaging structure 1 is performed in reverse sequence, wherein the first step, namely releasing the mushroom-shaped protrusions 203 from the openings of the protrusions 201 and pivoting back of the lateral clamping webs 200, is shown in FIG. 10*d*.

FIGS. 10*e* to 10*h* show details of a further packaging structure, wherein the lower part is fixed in the upper part of positive-locking (form-fitting) or clamping. According to FIG. 10*e*, guiding tracks 205 are formed along the side walls 23 of the lower part 20, which are rectangular in profile, which can be implemented easily e.g. by thermal deformation of lateral portions of lower part 20. Flat connecting webs 204 are formed between the guiding tracks 205 and the side walls 23, the undersides of which preferably lie in a common plane together with the lower edge of the box-shaped lower part 20.

Figure 10E:
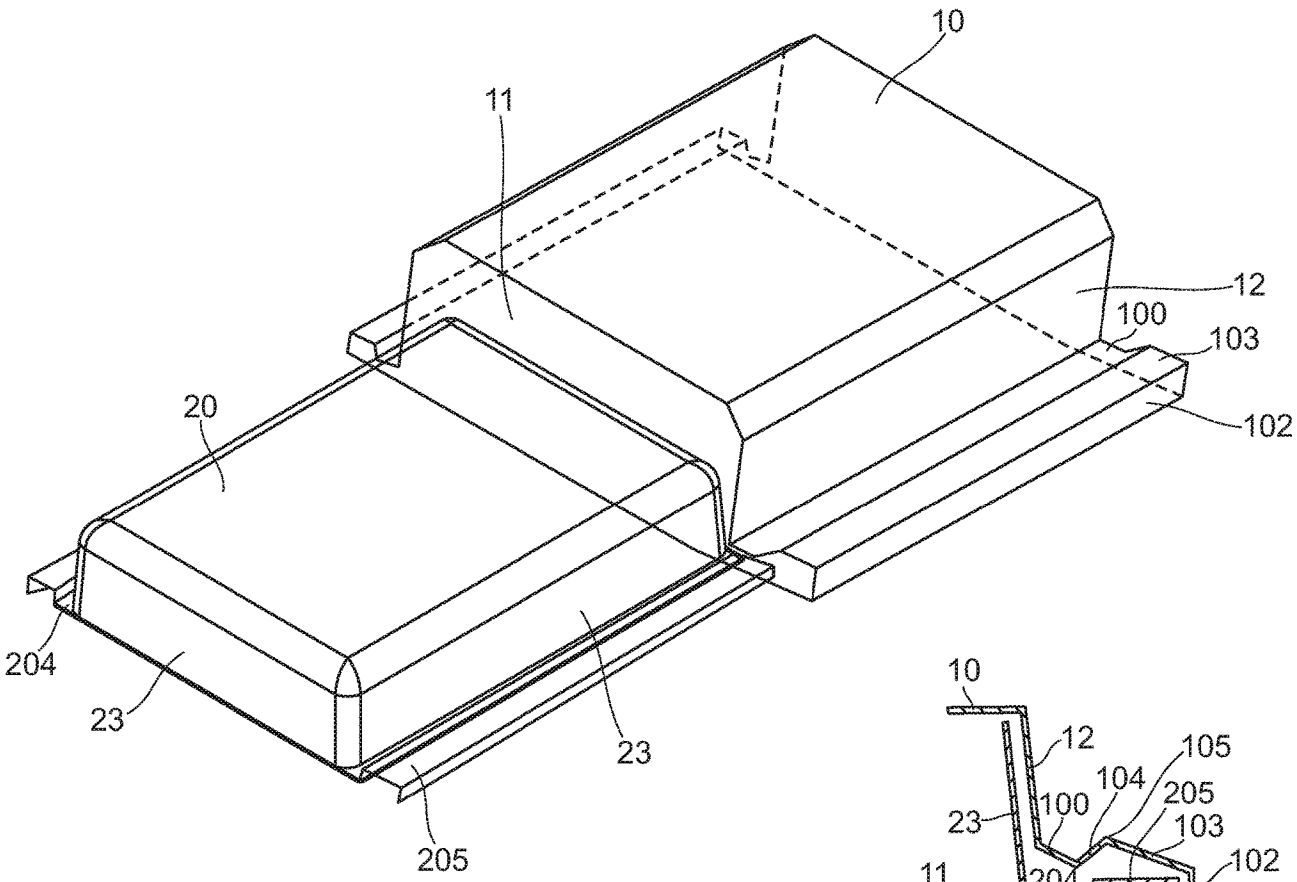

According to FIG. 10*e*, the front and rear ends of the upper part 10 are designed to be open, so that the lower part 20 can be pushed in. The bottom 11 of the upper part 10 is designed to be closed, but may in principle be provided with perforations which can be sealed by a gas permeable plastic foil, as described above. Furthermore, the edge portions of the upper part 10 are formed in correspondence to the guiding tracks 205 of the lower part 20 so that these can be accommodated in a positive fit manner or clamped in the edge portions of the upper part 10 after pushing the lower part 20 into the upper part 10.

Figure 10F:
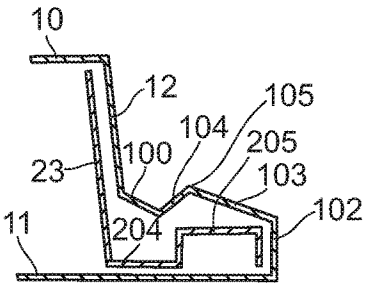
Figure 10G:
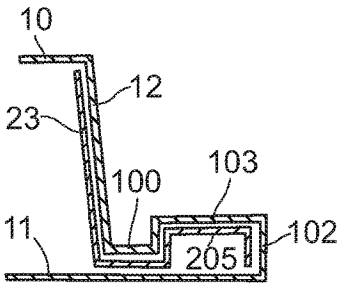

This state, in which the upper part 10 is positively accommodated or clamped in the edge portions of the upper part 10 is shown in the right-hand part II of the greatly enlarged partial section of FIGS. 10*f* and 10*g*. As shown, the edge portions of the upper part 10 are formed by a vertical side wall 102, a horizontal connecting web 103 and a vertical connecting web. In the locked or clamped state II of the lower part 20, the side wall 102 extends in parallel with and at a small or virtually vanishing distance to the side wall of the guiding track 205 and the horizontal connecting web 103 extends in parallel with and at a small or virtually vanishing distance to the upper side of the guiding track 205. Instead of clamping, additional form-fitting structures may be provided in this area, for example pushbuttons or elements positively cooperating with each other, such as recesses and protrusions corresponding thereto.

In order to permit simple insertion of the lower part 20 into the upper part 10, the edge portions of the upper part 10 may be adjusted according to the left part I of FIGS. 10*f* and 10*g*, for example, by providing folding lines in the edge portions about which the connecting webs and side walls can be pivoted. In the unfolded or open state I, which is shown in FIG. 10*f*, folding lines are e.g. provided in the transition areas 100→104, 104→103 and 103→102 in parallel to the side walls 12 of the upper part 10, about which the associated webs 103, 104, 100 can be pivoted upwardly to release the lower part 20 from the upper part 10 or to permit an insertion. In order to stably maintain the state II according to FIGS. 10*f* and 10*g*, it may be of advantage if the aforementioned side wall portions of the upper part 10 are elastically biased to the position of the state II due to their material characteristics. Or additional form-fitting structures in this region, as stated above, fix the state II.

Figure 10H:
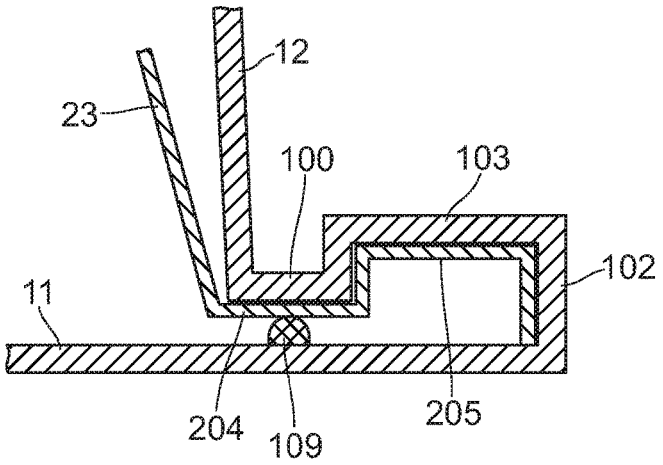

To further seal the packaging structure, according to the enlarged partial sectional view of a further embodiment, as shown in the FIG. 10*h*, an elastic sealing member 109 may be provided between the underside of the horizontal connecting web 204 of the lower part 20 and the bottom 11 of the upper part, which may, for example, be implemented as an elastic insert of a rubber or plastic material, which may also be injected into the bottom 11 of the upper part 10 using 2K (two-component) technology, or by forming an elastic sealing member directly in the bottom 11 of the upper part 10 or on the underside of the connecting web 204.

Such a sealing between the upper and lower part may, of course, also be provided in all other embodiments described herein at a suitable location to seal the packaging structure against the environment, preferably to seal the packaging structure sterile.

Figure 11A:
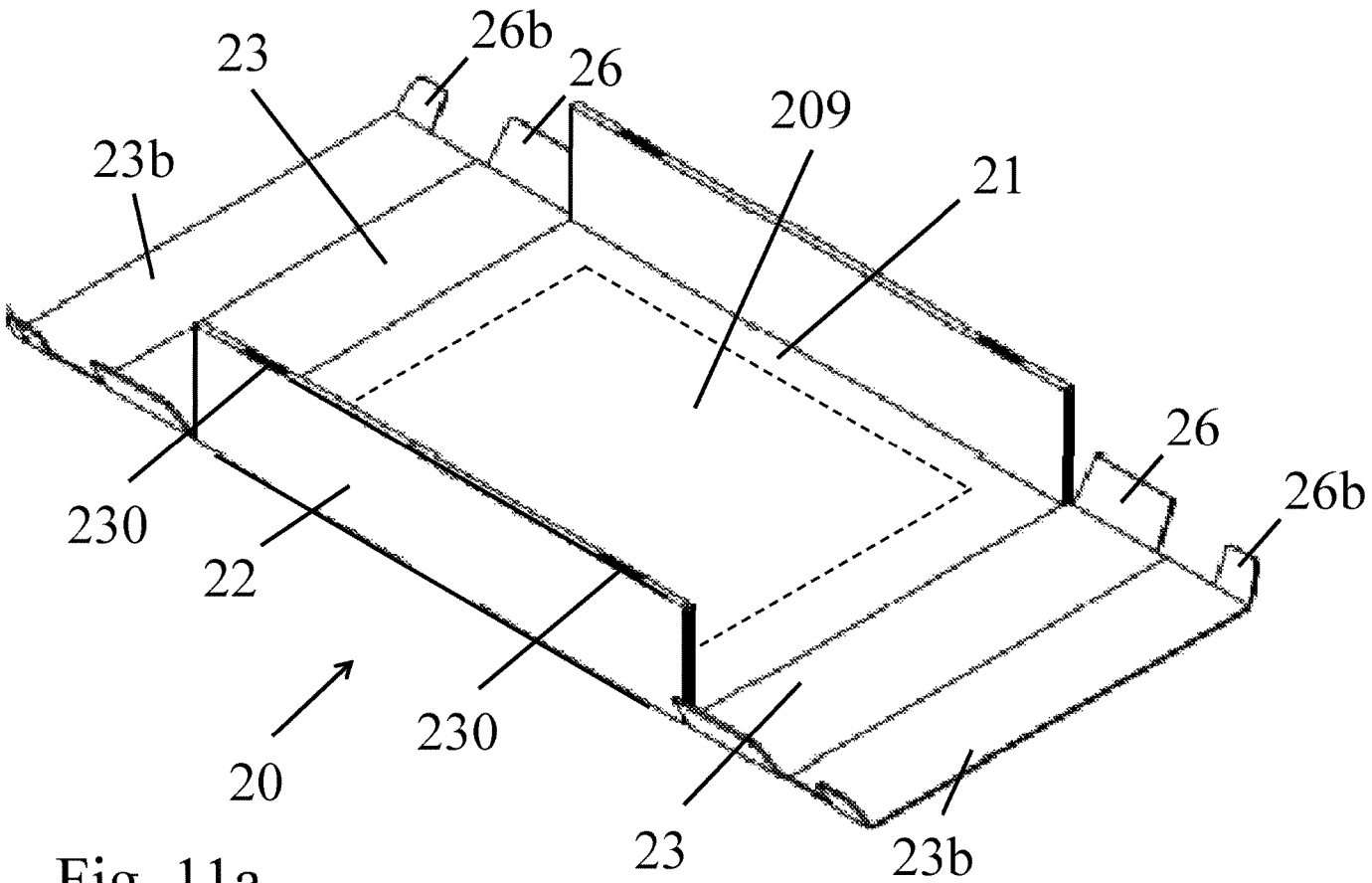

FIGS. 11*a* to 11*d* show details of a packaging structure according to a further embodiment of the present invention. The lower part 20 is basically formed similar to FIG. 1*a*. Here, in the region 209 indicated by dotted lines in principle also perforations may be provided in the bottom 21, which may be covered by a gas permeable plastic film, as described above. The lower part 20 according to FIG. 11*a* is folded in a manner similar to FIG. 8*a* to a box-shaped lower part. For this purpose, the front side walls 23 are further folded at the level of the side walls 22. When folding the front side walls 23 upward, the side lugs 26 are inserted into the gap between the inside of the side walls 22 and the upper part 10 (see FIG. 11*b*). When folding the foremost portion 23*b* of the side wall 23, the side flaps 26*b* formed thereon are inserted into recesses 230 formed on the upper edge of the side walls 22.

Figure 11B:
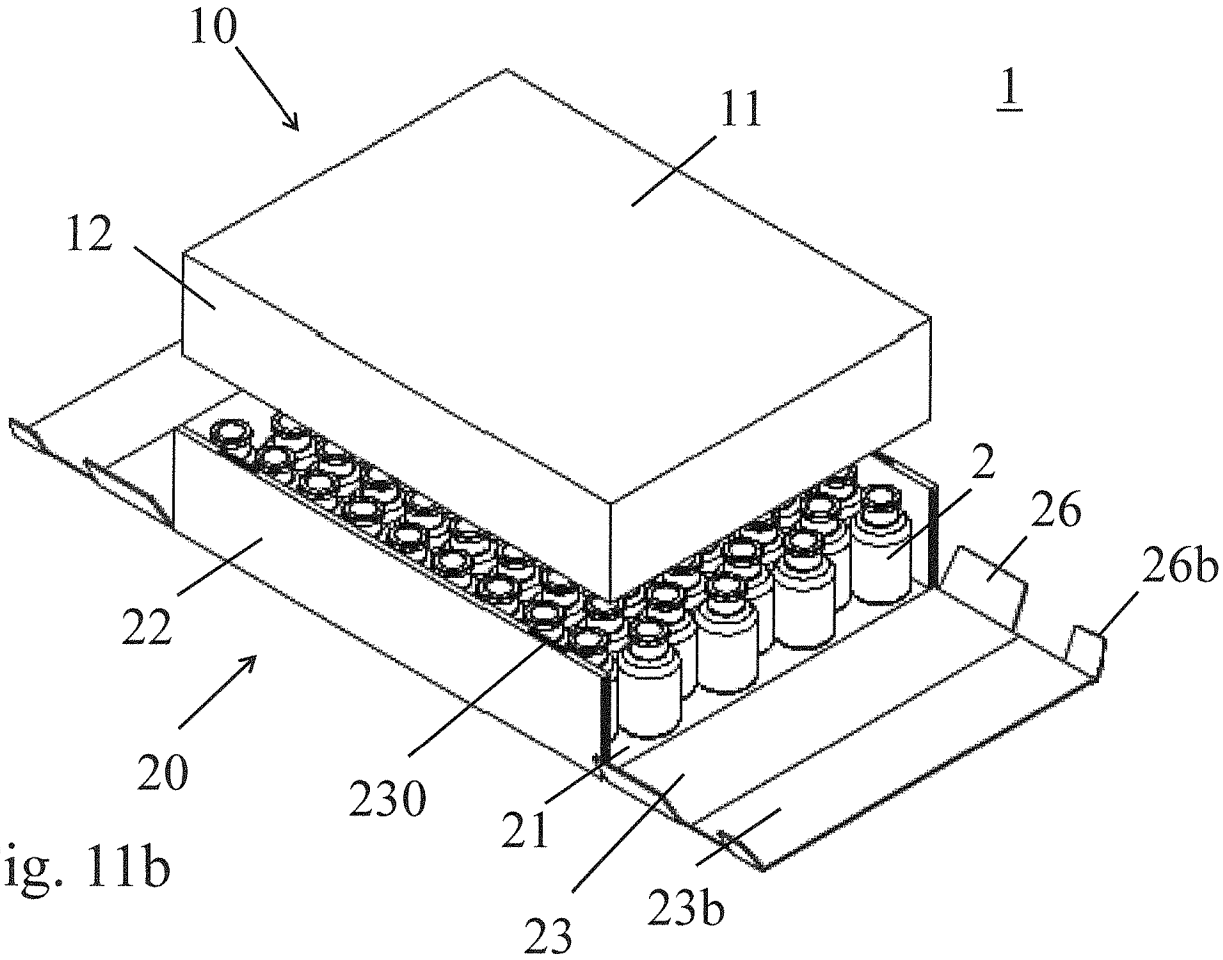
Figure 11C:
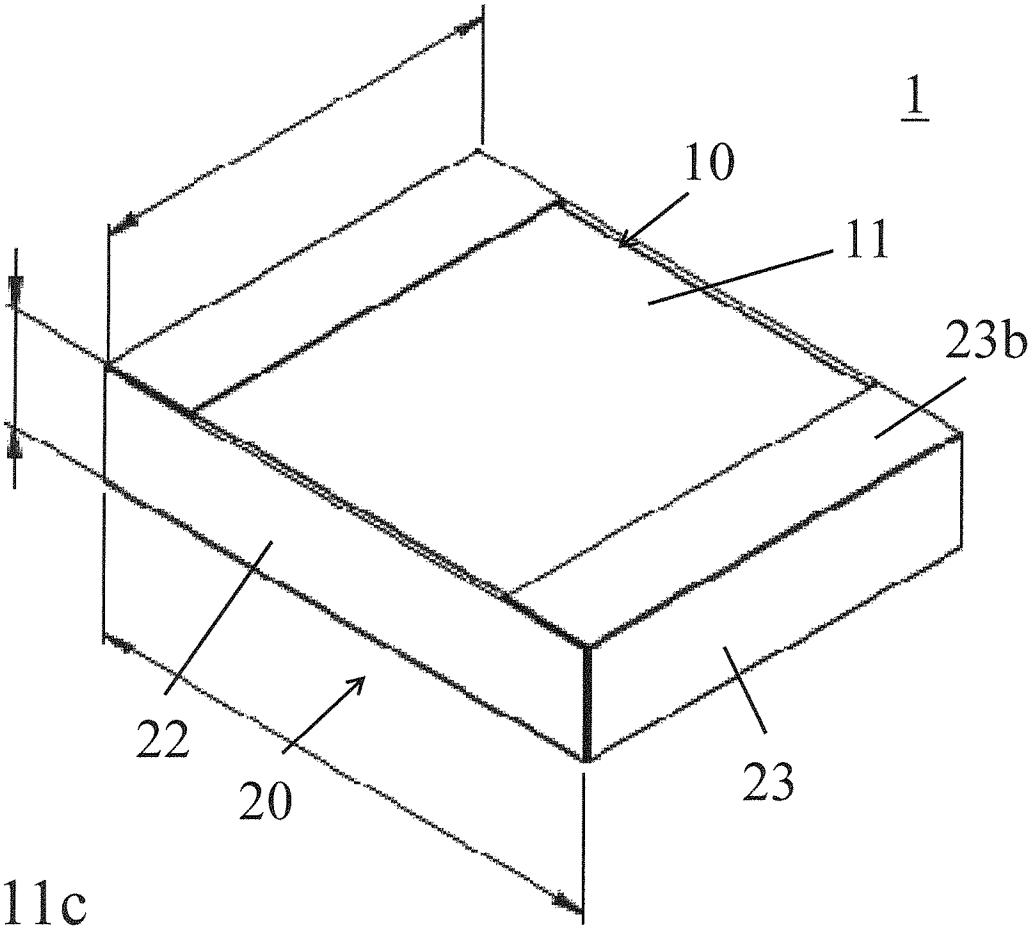

For forming the packaging structure 1, according to FIG. 11*b* the containers 2 are first inserted into the interior of the lower part 20 between the side walls 22 in the desired arrangement, with the front side walls 23, 23*b* still folded down or at least with the front side lugs 26*b* not yet inserted into the recesses 230. Alternatively, the containers 2 are first inserted into the box-shaped upper part 10 and then pushed into the interior of the lower part 20 by means of the upper part 10. Subsequently, the front side panels 23, 23*b* are folded in the manner described above and, finally, the front side lugs 26*b* are inserted into the recesses 230. Such a packaging structure 1 is shown in FIG. 11*c*. Here, the two front side walls 23*b* secure the upper part 10 in the lower part 20. Further, the upper ends of the containers are always covered by the bottom 11 of the upper part 10, so that impurities cannot intrude into the interior of the containers.

For opening the packaging structure 1, the above procedure is carried out in reverse sequence, i.e. the front side lugs 26*b* (see FIG. 11*b*) are first withdrawn from the recesses 230, then the front side walls 23, 23*b* are folded downward and finally the upper part 10 either together with the containers 2 is pushed out of the lower part 20 or the upper part 10 is removed and lifted upwards to release the containers 2 for further processing.

The upper part 10 is preferably formed as a thermal molding member of a plastic material.

Figure 11D:
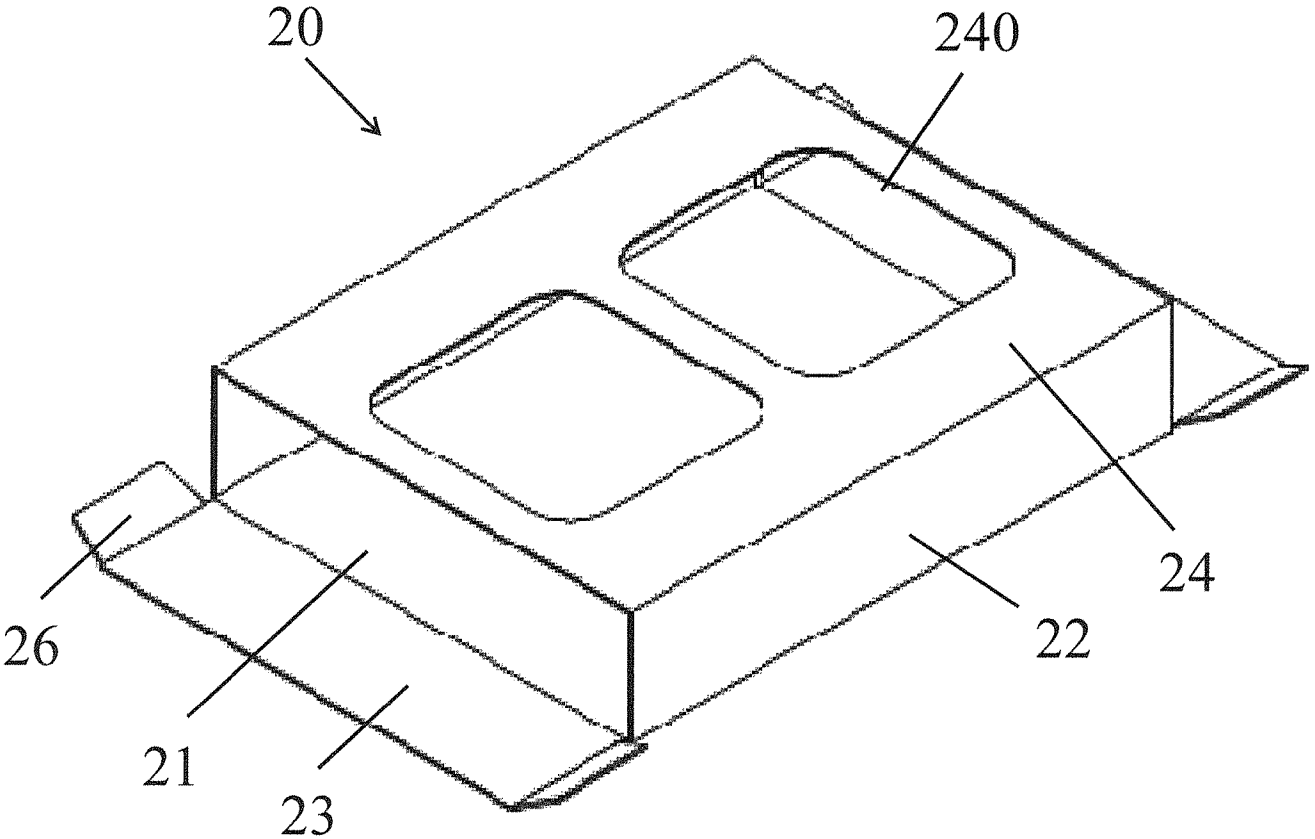
Figure 11E:
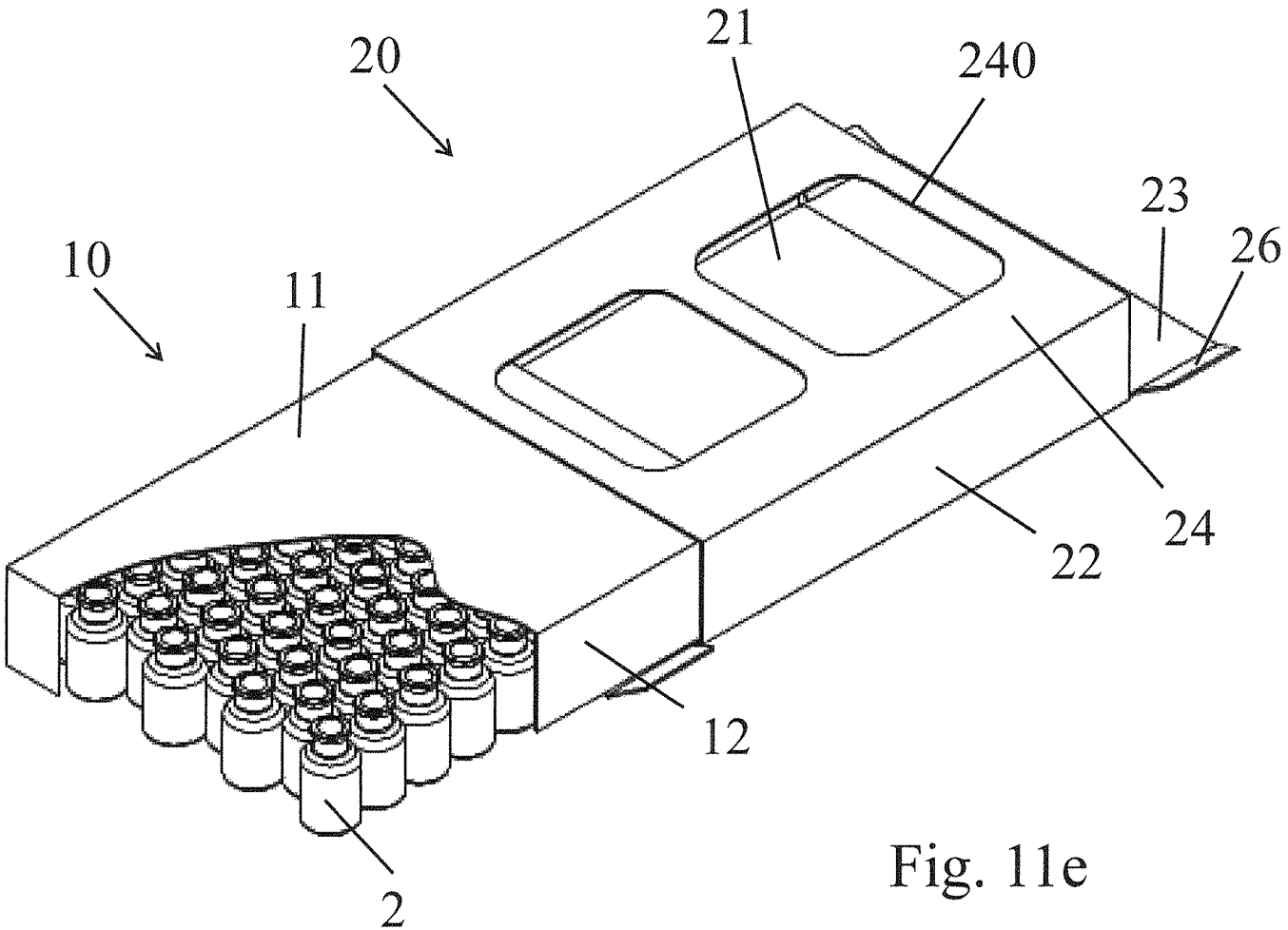

FIGS. 11*d* and 11*e* show a further embodiment in which the lower part 20 comprises, in the manner of the lower part according to FIG. 3*e*, an upper cover having two openings 240, which enable a conditional engagement into the interior of the lower part 20. The front side walls 23 can be folded down. For securing the packaging structure, the front side walls 23 are folded upward after the insertion of the upper part 10 shown in FIG. 11*e* into the lower part 23 and thereby the side lugs 26 are inserted into the gap between the inner walls 22 of the lower part 20 (see FIG. 11*d*) and the side walls 12 of the upper part 10.

The openings 240 can be sealed by a plastic foil, in particular a gas-permeable plastic film, as described above, whereby a sterile packaging structure is formed.

Of course, the upper and lower part 10, 20 may also be arranged reversed for forming the packaging structure so that the containers 2 rest on the bottom 11 of the upper part 10 with their front ends upside down and that the upper part 10 is then inserted into the lower part 20. In the orientation shown in FIG. 11*e*, however, the underside of the upper part 10 may first be supplemented by an intermediate bottom (not shown), on which the containers 2 are supported at their lower ends, and on which the upper part 10 is then inserted into the lower part 10 in the orientation of FIG. 11*e*.

Referring to FIGS. 12*a* to 12*d*, in the following a packaging structure according to a further embodiment will be described. In this package structure, the lower part is formed by a plane base plate 70, whose circumferential edge 71 is formed elevated, whereby a central trough-shaped depression 72 for accommodating the box-shaped upper part 10 together with the containers (not shown) accommodated therein is formed. The height of the peripheral edge 71 corresponds to the thickness of the flange 15 of the upper part 10 or is larger than this thickness, so that the flange 15 can be accommodated completely in the recess 72 without protruding from the edge 71.

For sealing or sterile packaging of the structure formed by base plate 70 and upper part 10 a box-shaped hood 80 is used which has a bottom, a circumferential side wall 81 and a horizontal flange 83. The enlarged partial section in FIG. 12*c* shows an edge portion of this packaging structure before sealing. As shown, a bonding or adhesive strip 73 is formed circumferentially on the upper edge 71. As shown in FIG. 12*d*, the flange 83 of the hood 80 is connected to the upper edge 71 of the base plate 70 by means of the bonding strip or adhesive strip 73 by pressing down the upper part 10 into the trough-shaped receptacle 72 of the base plate 70. For bonding, a heat sealing may also be used, effected by a thermal treatment of the edge region of the assembly after placing the upper part 10 on the base plate 70 and putting on the hood 80. FIG. 12*b* shows the completed packaging structure.

FIG. 13 shows in a schematic flow diagram the steps of a method according to the present invention for forming and re-opening of a package structure.

First, in step S1, the plurality of containers is inserted into the upper or lower part of the packaging structure. This can be done by placing a plurality of containers on a flat surface and then pushing the containers into the upper or lower part, wherein the side walls thereof can serve as guiding devices for guiding the containers automatically to the desired arrangement. A closest packing can be achieved automatically, for example, during insertion of the containers by means of a pusher or the like. Alternatively, the containers can be arranged in a box-shaped upper or lower part, for example by putting on the upper or lower part, wherein the side walls of the upper or lower part serve as guiding devices for the containers to define the arrangement of the containers therein. Alternatively, the containers can be inserted into the upper or lower part of the packaging structure in principle also by means of any transport device, particularly by means of gripping arms or belt conveyors.

For insertion of the containers, the upper or lower part can be used, into which the containers are first inserted. The containers and/or the upper or lower part accommodating the latter can also be inserted by means of a pusher or the like. For this purpose, it may be of advantage if a gap remains in the packaging structure between the upper and lower part or an intermediate part, which is the case for example in the packaging structure according to FIG. 5*b*, because a pusher or the like can pass through this gap to mechanically operate directly on the containers.

Subsequently, in step S3, the sealing of the packaging structure is performed. For this purpose, the upper or lower part with the containers accommodated therein can be pushed into the corresponding lower or upper part. Or the upper part is simply placed on the lower part with the containers accommodated therein and is possibly further connected to the lower part, for example by inserting tabs provided on the top or bottom into corresponding apertures or recesses provided at the lower or upper part. A processing of the containers in an intermediate step S2 may be performed before this step, while these are accommodated in the upper or lower part of the packaging structure, e.g. a heat treatment, sterilization or filling of the containers with a substance.

Finally, the packaging structure can be sealed in step S4 in order to complete the packaging structure, for example by insertion into a tube or into sealable bag of a suitable sterile plastic material, or by placing on and connecting a hood, as described above with reference to FIGS. 12*a* to 12*d*.

The opening of the packaging structure in step S5 and a further processing of the containers in step S6 may follow as a further method steps. These steps can be carried out at purchaser of the packaging structure, for example at a producer of pharmaceuticals.

In this method, there is no need to turn the containers, contrary to the prior art, but these can be transported and further processed in the same orientation.

Furthermore, preferably the containers can be pushed out of the packaging structure free of particles. Free of particles in the sense of the present application means in particular that no foreign particles of a diameter greater than 20 microns remain in the container.

Preferred Materials and Methods of Manufacturing

As elastic inserts, partition walls or side walls for biasing the containers against each other or for elastically clamping the containers in the packaging structure as described above, preferably elastic or compressible foamed plastic materials are used, in particular thermoplastic foams (e.g. PS-E PP-E and PVC-E), elastomeric foams (e.g. soft PUR foam, NBR) or thermosetting foams (e.g. rigid PUR foam, PF).

The plastic foams can be produced particularly by foam extrusion, a molding process, by a thermoplastic foam molding process (TSG) or, when using PUR foams, also by continuous belt foaming, discontinuous RSG (reaction foam molding), RIM (reaction injection molding) or low-pressure processes and high-pressure processes or RRIM (Reinforced Reaction Injection Molding).

In any case, the upper or lower part that accommodates the containers in a clamped state is formed at least in sections of a thermoplastic, thermosetting or elastomeric plastic material, which has a certain elasticity. More preferably, the material Akylux® is considered for use, which consists of polypropylene with twin-walled sheets. Akylux® is durable and reusable, mold resistant and moisture resistant, suitable for hygienic applications, because no fiber formation occurs at the surface, shock-absorbing, sufficiently rigid, chemically inert, non-toxic (the raw material as well as most colors are food-safe), 100% recyclable, printable (for example, by screen printing or flexo printing), resistant against gamma rays (tested with a load of 25 kGy), allows a sterilization process with ethylene oxide (gas), allows a thermal treatment (e.g. for 72 hours between 50° C. and 60° C. depending on the conditions of use), has a sufficiently high softening point (Vicat: 145° C. at 10N (ISO R 306)) and a sufficiently high melting point (160° C.-165° C. (DSC)).

The bottom particularly of the lower part or of the planar support surface used, on which the containers are temporarily disposed, may be coated with a sliding layer to facilitate the above-insertion of the upper part with the containers accommodated therein into the lower part, as described above. The sliding layer may consist of a polymer and a layer of a bonding agent. The sliding layer should preferably consist at least of a mixture of an aromatic silane and an aliphatic silane. Other suitable materials for the lower part are, for example, polyamide or polyoxymethylene (POM).

As will become apparent to the person skilled in the art upon reading the foregoing description, various changes and modifications can be made without departing from the general spirit and scope of the present invention as defined in the appended claims. It is therefore intended that such changes and modifications shall be covered by the scope of protection of the present invention.

LIST OF REFERENCE NUMBERS

1 packaging structure
2 containers
3 bottom
4 side wall
5 neck/constricted neck portion
6 upper edge
7 filling opening
9 sleeve or plastic bag
10 upper part
100 lower clamping web
101 side wall of the lateral extension
102 upper surface of lateral extension
103 upper clamping web
104 connecting web
105 folding line
109 sealing member
11 bottom
11*a* grid structure
12 side wall
13 front side wall
14 recess/opening
15 flange
16 latching recess
17 guiding groove
20 lower part
200 clamping web
201 stop
202 recess
203 protrusion
204 lateral extension
205 lateral clamping and guiding track
209 region with perforations
21 bottom
22 side wall
22*a* perforation
22*b* doubled side wall
23 front side wall or rear wall
23*b* doubled front side wall
230 recess/opening
24 upper cover
240 opening
25 insertion opening
26 front side lug
26*a* additional side lug
27 recess
28 protrusion
29 sealing member
30 rear wall
31 rear side lug
32 recess
33 protrusion
34*a*-34*f* folding lines
35 lug
37 elastic insert or pusher
38 blind hole, bore
39 displacement device
40 intermediate part
41 bottom
42 side wall
43 front wall
50 accommodating jig
51 flat surface
52 side wall
53 rear wall
60 side wall of spacer
61 rear wall of spacer
62 displacement device
70 base plate
71 elevated edge of base plate
72 receptacle in base plate
73 adhesive edge or heat sealing edge
80 sterile hood
81 side wall of hood
82 front side wall of hood
83 flange/circumferential edge

What is claimed is:

1. A package, comprising:

a packaging structure; and a plurality of containers for substances for medical, pharmaceutical or cosmetic applications, wherein the plurality of containers are in the packaging structure, and wherein the containers have a cylindrical side wall and a bottom or a lower edge extending perpendicularly to the side wall, the packing structure comprising:

a box-shaped upper part; and a flat or lower part comprising a flat bottom, side walls between the upper part and the lower part, wherein the plurality of containers are directly on the flat bottom of the lower part and are perpendicular to the flat bottom, wherein the upper part is at the upper ends of the plurality of containers or on a box-shaped intermediate part, which is placed at the upper ends of the plurality of containers, wherein the positions of the plurality of containers on the flat bottom of the lower part are fixed by the side walls that protrude perpendicularly from at least one of the bottom of the lower part and the upper part, and wherein the lower part comprises a plastic sheet and two clamping webs extending along two opposite longitudinal sides of the flat bottom, and wherein each clamping web is formed by folding a respective longitudinal edge of the plastic sheet so that the plurality of containers together with the upper part placed on the upper ends of the plurality of containers or on the intermediate part can be displaced from a flat surface onto the bottom of the lower part, wherein the package further comprises:

a sleeve or resealable bag made of a plastic material, wherein the packaging structure and the plurality of containers are in the sleeve or resealable bag; and a latch, wherein the lower part and the upper part are detachably connected to each other with the latch.

2. The package of claim 1, wherein the lower part comprises at least one side wall that can be removed or opened by folding downward or laterally.

3. The package of claim 1, wherein the upper part and/or the lower part is configured so that the containers contact each other directly in the box-shaped receptacle and cannot be displaced relative to each other.

4. The package of claim 1, wherein the lower part is made of a material or is provided with a slide coating having a coefficient of friction with respect to the material of the containers of less than 0.6.

5. The package of claim 1, wherein the upper part comprises lateral edges that are folded along folding lines to form the side walls of the upper part.

6. The package of claim 1, wherein the sleeve or resealable bag further comprises a gas-permeable plastic foil as a seal, and wherein the gas-permeable plastic foil is a web or film of synthetic fibers.

7. The package of claim 6, wherein the bottom of the upper part and/or of the lower part and/or the side walls of the upper part and/or of the lower part have perforations, which are sealed by the gas-permeable plastic foil.

8. The package of claim 1, further comprising guiding structures that are formed along side walls of the lower part, the guiding structures extending in the longitudinal direction of the lower part and which are guided by side walls of the upper part upon insertion of the lower part into the upper part.

9. The package of claim 8, wherein the guiding structures are accommodated by correspondingly shaped side wall portions of the upper part by positive locking or frictional locking.

10. The package of claim 1, wherein the side walls of at least one of the lower part and the upper part are elastic at least in sections, so that the containers are accommodated in the box-shaped receptacle so as to be biased resiliently against each other and so that a slippage of the containers relative to each other in the box-shaped receptacle is prevented.

11. The package of claim 1, wherein the side walls of at least one of the lower part and the upper part are formed at least in sections from a material that is selected from the group consisting of a thermoplastic, thermosetting or elastomeric plastic, wherein the material is foamed or formed as a twin-walled sheet having hollow chambers.

* * * * *